US006435329B1

(12) United States Patent
Amari et al.

(10) Patent No.: US 6,435,329 B1
(45) Date of Patent: Aug. 20, 2002

(54) MONEY HANDLING APPARATUS

(75) Inventors: Isao Amari, Katsunuma-cho; Hiroyuki Oiyama, Anayama-machi; Ikugo Mitsui, Oizumi-mura, all of (JP)

(73) Assignee: Nihon Kinsel Kikai Kabushiki Kaisha, Osaka (JP)

( * ) Notice: Subject to any disclaimer, the term of this patent is extended or adjusted under 35 U.S.C. 154(b) by 0 days.

(21) Appl. No.: 09/549,248

(22) Filed: Apr. 14, 2000

(51) Int. Cl.[7] ..... G07F 9/10
(52) U.S. Cl. ..... 194/206; 194/350
(58) Field of Search ..... 194/206, 350, 194/203; 312/35, 91

(56) References Cited

U.S. PATENT DOCUMENTS 5,533,605 A * 7/1996 Mays et al. ..... 194/206
5,615,625 A * 4/1997 Cassidy et al. ..... 109/45
5,740,897 A * 4/1998 Gauselmann ..... 194/206
5,836,510 A * 11/1998 Kirchner ..... 232/15
5,873,446 A * 2/1999 Wei ..... 194/350
6,068,101 A * 5/2000 Dickenson et al. ..... 104/206
6,202,823 B1 * 3/2001 Howard et al. ..... 194/217
6,289,261 B1 * 9/2001 Heidel et al. ..... 700/231

* cited by examiner

*Primary Examiner*—Donald P. Walsh
*Assistant Examiner*—Mark J. Beauchaine
(74) *Attorney, Agent, or Firm*—Rosenthal & Osha L.L.P.

(57) ABSTRACT

A movable table is insertably and withdrawably mounted on a casing. A depositing/dispensing mechanism for discriminating the note type and genuineness of a note deposited at the entrance of a conveyance path for conveying the note, feeding the note to a storing end corresponding to the discrimination result, and dispensing note(s) from its storing end by a specified input operation is mounted on the movable table. A controller for calculating a balance by detecting the depositing/dispensing of the notes is also provided. The depositing/dispensing mechanism includes a first mechanism for holding the deposited and dispensed notes before being calculated for the balance and a second mechanism for holding the deposited and dispensed notes after being calculated for the balance. The first and second mechanisms are provided at front and rear sides of the movable table with respect to a drawing direction, respectively. Accordingly, the jammed note can be easily handled without having any anxiety factor in view of security.

13 Claims, 15 Drawing Sheets

MONEY HANDLING APPARATUS

This application is based on patent application No. 10-342153 filed in Japan, the contents of which are hereby incorporated by references.

BACKGROUND OF THE INVENTION

This invention relates to a money handling apparatus such as a note depositing/dispensing apparatus installed mainly at a supermarket or a retail store such as a specialty store.

Cash registers are installed at supermarkets and retail stores such as specialty stores, and customers having purchased goods or commodities are generally served one by one for payment by these cash registers. Due to an insufficient capacity of the cash registers and for the security purpose, money handling apparatuses such as note depositing/dispensing apparatuses electrically connected with the cash registers are frequently installed separately from the cash registers. The note depositing/dispensing apparatuses are adapted to deposit and dispense notes having a denomination of $1 or larger and used to pay out changes for large denomination notes and to exchange. Particularly, since large denomination notes such as $100-note are not used as a change, they are normally deposited immediately after being received from customers.

Such a depositing/dispensing apparatus is provided with an inserting section on which notes to be inserted into the depositing/dispensing apparatus are placed, an introducing section for introducing the notes placed on the inserting section one by one, a discriminating section for discriminating the types and genuineness of notes introduced by the introducing section, a sorting section for sorting the notes based on the discrimination result of the discriminating section, a storing section for separately storing the sorted notes, and a conveying section for conveying the notes from an upstream side to a downstream side inside the depositing/dispensing apparatus.

The respective sections are placed on a movable table insertably and withdrawably mounted in a casing. This movable table is normally accommodated in the casing, but is drawn from the casing upon an occurrence of a note jam and during maintenance to remove the jammed note and inspect the respective sections exposed to the outside.

With the conventional note depositing/dispensing apparatus, when, for example, a note jam occurs, the movable table is entirely drawn from the casing, and a position of jamming is searched with all the interior mechanisms exposed. This causes a security problem.

Even if an operator succeeds in searching the position of jamming and removing the jammed note, it is frequently unclear whether the inserted note has been already counted or not. Specifically, the inserted note may be put into the storing section if having been already counted, whereas it may be inserted through the inserting section unless otherwise. However, if it is not clear whether the inserted note has been already counted or not, the removed note cannot be properly handled.

Usually, a register operator or cashier cannot judge how he/she should handle the note removed from the position of jamming. In the end, he/she has to ask for a help from an administrator of the store. Since an operation is interrupted at the cashier, this causes much trouble to customers and causes a reduced operation efficiency.

SUMMARY OF THE INVENTION

It is an object of the present invention to provide a money handling apparatus which is free of the above problems residing in the prior art.

According to an aspect of the invention, a money handling apparatus is provided with a casing and a movable table insertably and withdrawably mounted in the casing. A note handling mechanism is mounted on the movable table for performing deposition of notes. The note handling mechanism includes: a first mechanism provided at a front side of the movable table with respect to a drawing direction for transferring a note rearward at the time of depositing, and a second mechanism provided at a rear side of the movable table with respect to the drawing direction for permitting the deposited note to be stored. There are provided a restricting device for restricting the drawing movement of the movable table from the casing to a first drawing position where only the first mechanism is exposed to the outside, and a restriction controller for releasing the restriction of the restricting device so as to enable the movable table to be drawn up to a second drawing position where the second mechanism is exposed to the outside.

These and other objects, features and advantages of the present invention will become more apparent upon a reading of the following detailed description and accompanying drawings.

BRIEF DESCRIPTION OF THE DRAWINGS

FIGS. 7A and 7B are plan diagrams of a belt conveying a note, wherein FIG. 7A shows a proper conveyance of the note and FIG. 7B shows an occurrence of a note jam;

FIGS. 9A and 9B are plan views in section showing a first locking device, wherein FIG. 9A shows a state where a movable table is locked so as not to be drawn, and FIG. 9B shows a state where the movable table is unlocked;

FIGS. 10A and 10B are plan views in section showing a second locking device, wherein FIG. 10A shows a state where the movable table is locked so that it cannot be drawn from a first drawing position, and FIG. 10B shows a state where the above locking is released;

DETAILED DESCRIPTION OF THE PREFERRED EMBODIMENTS OF THE INVENTION

Figure 1:
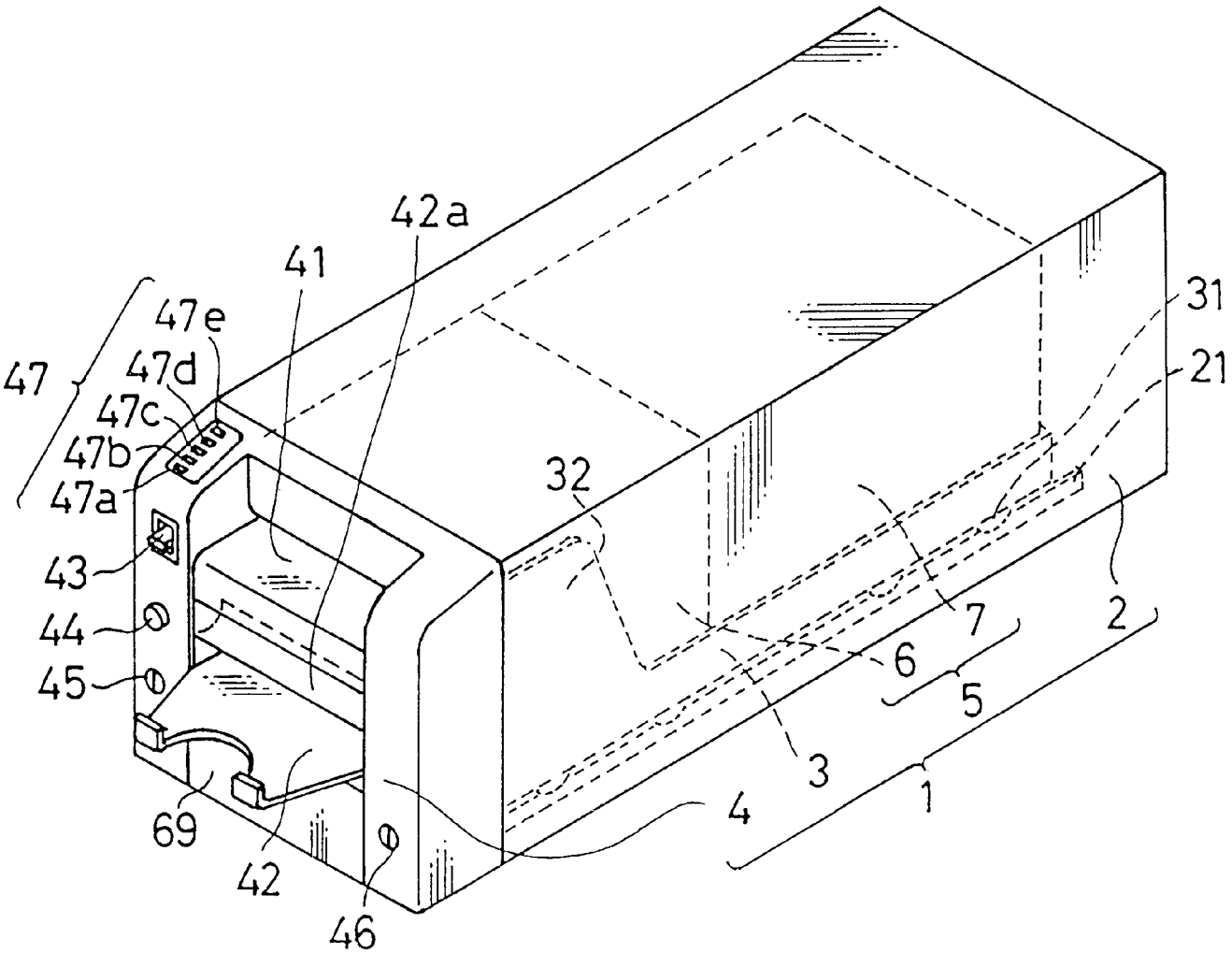
FIG. 1 is a perspective view of a note depositing/dispensing apparatus according to an embodiment of the invention.

FIG. 1 is a perspective view of a note depositing/dispensing apparatus according to an embodiment of the invention. As shown in FIG. 1, the note depositing/dispensing apparatus 1 is basically comprised of a box-shaped casing 2, a movable table 3 insertably and withdrawably mounted in the casing 2, a panel portion 4 mounted on the front end (left side in FIG. 1) of the movable table 3, and a depositing/dispensing mechanism 5 mounted on the movable table 3 behind the panel portion 4. The depositing/dispensing mechanism 5 includes a first mechanism 6 formed at its front side and a second mechanism 7 formed at its rear side.

A pair of guide rails 21 (only one guide rail 21 is shown in FIG. 1 for the sake of convenience) extending along forward/backward directions are laid on the inner surface of the bottom wall of the casing 2. On the other hand, a plurality of rollers 31 guided by the guide rails 21 are provided at the bottom of the movable table 3. The movable table 3 can be easily inserted into and drawn from the casing 2 by the rotation of the rollers 31 about their support shafts.

The panel portion 4 has a box shape which has the same front view as the casing 2 and whose dimension along forward/backward directions is short. A note inlet 41 for inserting notes is formed at the front upper corner of the panel portion 4, and a note outlet 42 is formed in the middle. The notes are introduced into the depositing/dispensing mechanism 5 by being inserted through the note inlet 41. By conducting a dispensing operation in a specific manner, a specified number of notes stored in the depositing/dispensing mechanism 5 are dispensed through the note outlet 42. A recess into which finger tips can be inserted is formed at the upper end of the note outlet 42. By this recess, a grip 42*a* is formed at the upper end of the note outlet 42.

Further, a power switch 43 is provided at an upper end of one side of the front surface of the panel portion 4 and a table drawing enabling button 44 is provided below the power switch 43. The button 44 unlocks the movable table 3 which is normally locked so as not to be drawable. By holding the grip 42*a* by the finger tips of one hand and pulling the movable table 3 forward while pushing the button 44 by the other hand, the movable table 3 can be drawn from the casing 2 up to a first drawing position (position shown in FIGS. 4 and 5) where the first mechanism 6 is exposed from the casing 2.

A keyhole 45 is formed below the table drawing enabling button 44. By effecting unlocking by inserting a specified key into the keyhole 45, the movable table 3 can be drawn up to a second drawing position (position shown in FIG. 6) where the second mechanism 7 is exposed from the casing 2. Below the note outlet 42 is mounted a note collection box 69 to be described later. A keyhole 46 for locking and unlocking the box 69 to prohibit and permit the withdrawal of the box 69 is formed at the right side of the front surface of the panel portion 4.

Figure 2:
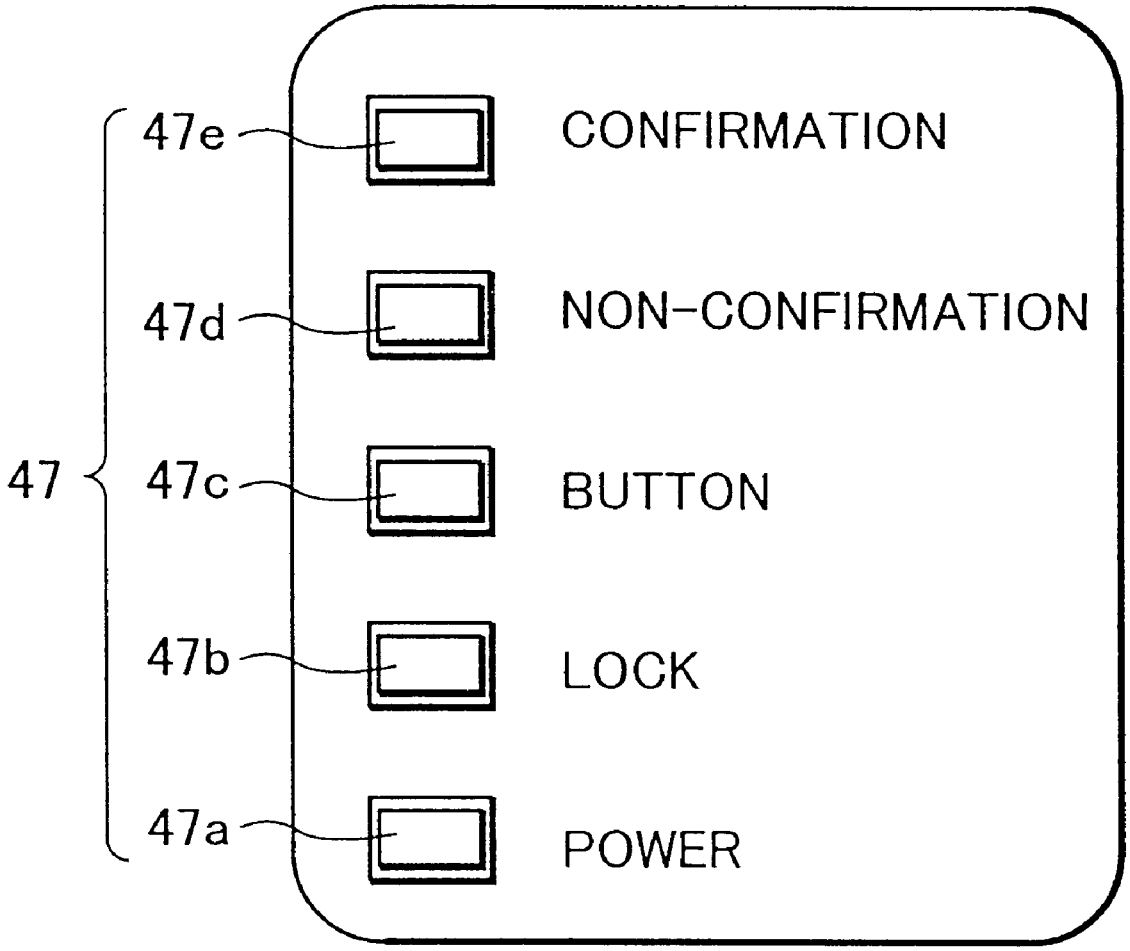
FIG. 2 is a plan view of an exemplary arrangement of lamps on a display unit.

A display unit 47 is provided at the left side of the upper surface of the panel portion 4. FIG. 2 is a plan diagram showing an exemplary arrangement of lamps of the display unit 47. As shown in FIG. 2, the display unit 47 shows an operative state of the note depositing/dispensing apparatus 1, and includes a power lamp 47*a*, a lock lamp 47*b*, a button lamp 47*c*, a non-confirmation lamp 47*d*, and a confirmation lamp 47*e*. The respective lamps 47*a* to 47*e* are labeled with Power, Lock, Button, Non-Confirmation and Confirmation.

The power lamp 47*a* indicates whether or not power is applied to the note depositing/dispensing apparatus 1. The lamp 47*a* is turned on when the power switch 43 is turned on while being turned off when the power switch 43 is turned off.

The button lamp 47*c* blinks upon the occurrence of a note jam in the first mechanism 6. When the button lamp 47*c* blinks, the table drawing enabling button 44 is pushed to draw the movable table 3 up to the first drawing position to expose the first mechanism 6 to the outside (see FIGS. 4 and 5), thereby enabling an operator to remove the jammed note.

The lock lamp 47*b* blinks upon the occurrence of a note jam in the second mechanism 7. When the lock lamp 47*b* blinks, the specified key is inserted into the keyhole 45 to unlock the movable table 3 and the movable table 3 is drawn up to the second drawing position to expose the second mechanism 7 to the outside (see FIG. 6), thereby enabling the operator to remove the jammed note.

The non-confirmation lamp 47*d* blinks upon the occurrence of a note jam while the inserted note has not yet been counted in the depositing/dispensing mechanism 5, i.e., the inserted note has not yet been registered. If the lamp 47*d* blinks during the depositing of the note, the note removed from the position of jamming is inserted through the note inlet 41 again. Further, if the lamp 47*d* blinks during the dispensing of the note, the removed note is stored in a rejected note container 69b (see FIG. 3) to be described later.

The confirmation lamp 47*e* blinks upon the occurrence of a note jam after the inserted note was counted in the depositing/dispensing mechanism 5, i.e., the inserted note was registered. If the lamp 47*e* blinks during the depositing of the note, the note removed from the position of jamming is stored in the rejected note container 69*b* since it has been already registered. Further, if the lamp 47*e* blinks during the dispensing of the note, the removed note is handled outside the depositing/dispensing apparatus 1 as having been paid out since it is already registered.

In this embodiment, upon the occurrence of a note jam, either one of the lock lamp 47*b* and the button lamp 47*c* blinks, and either one of the non-confirmation lamp 47*d* and the confirmation lamp 47*e* blinks. How the removed note should be handled can be known by the combination of the blinking lamps.

For example, if the button lamp 47*c* and the non-confirmation lamp 47*d* blink during the depositing of the notes, the movable table 3 is drawn up to the first drawing position by pushing the table drawing enabling button 44 to expose the first mechanism 6 to the outside, and the jammed note is removed. The removed note is inserted through the note inlet 41 again after the movable 3 is inserted back into the casing 2. Further, if the button lamp 47*c* and the confirmation lamp 47*e* blink, the jammed note removed from the first mechanism 6 is stored in the rejected note container 69*b*.

As described above, how the jammed note should be handled is determined by the combination of the blinking lamps. Ways of handling the jammed note in accordance with the combination of the blinking lamps are as shown in TABLE-1 below.

TABLE 1

| | Non-Conf. Lamp Blinking | | Conf. Lamp Blinking | |
|---|---|---|---|---|
| | Depositing | Dispensing | Depositing | Dispensing |
| Button Lamp Blinking | Draw only first mechanism out Reinsert the removed note through the note inlet | Draw only first mechanism out Store the removed note in the rejected note container | Draw only first mechanism out Store the removed note in the rejected note container | Draw only first mechanism out Reinsert the removed note through the note inlet |
| Lock Lamp Blinking | Draw to expose the second mechanism Reinsert the removed note through the note inlet | Draw to expose the second mechanism Store the removed note in the rejected note container | Draw to expose the second mechanism Store the removed note in the rejected note container | Draw to expose the second mechanism Store the removed note in the rejected note container |

Figure 3:
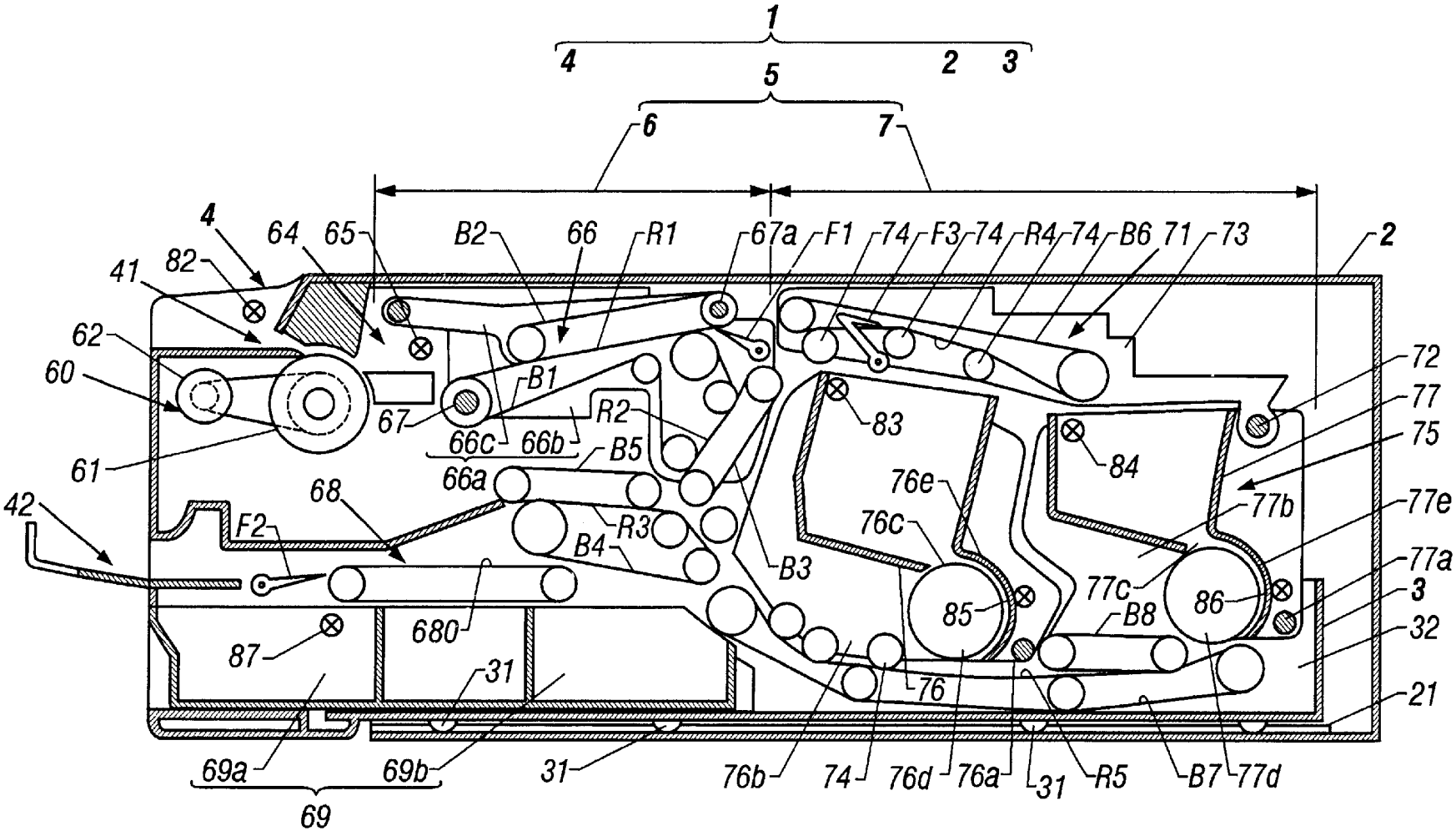
FIG. 3 is a side view in section of the note depositing/dispensing apparatus of FIG. 1, in which a depositing/dispensing mechanism is mounted in a casing.
Figure 4:
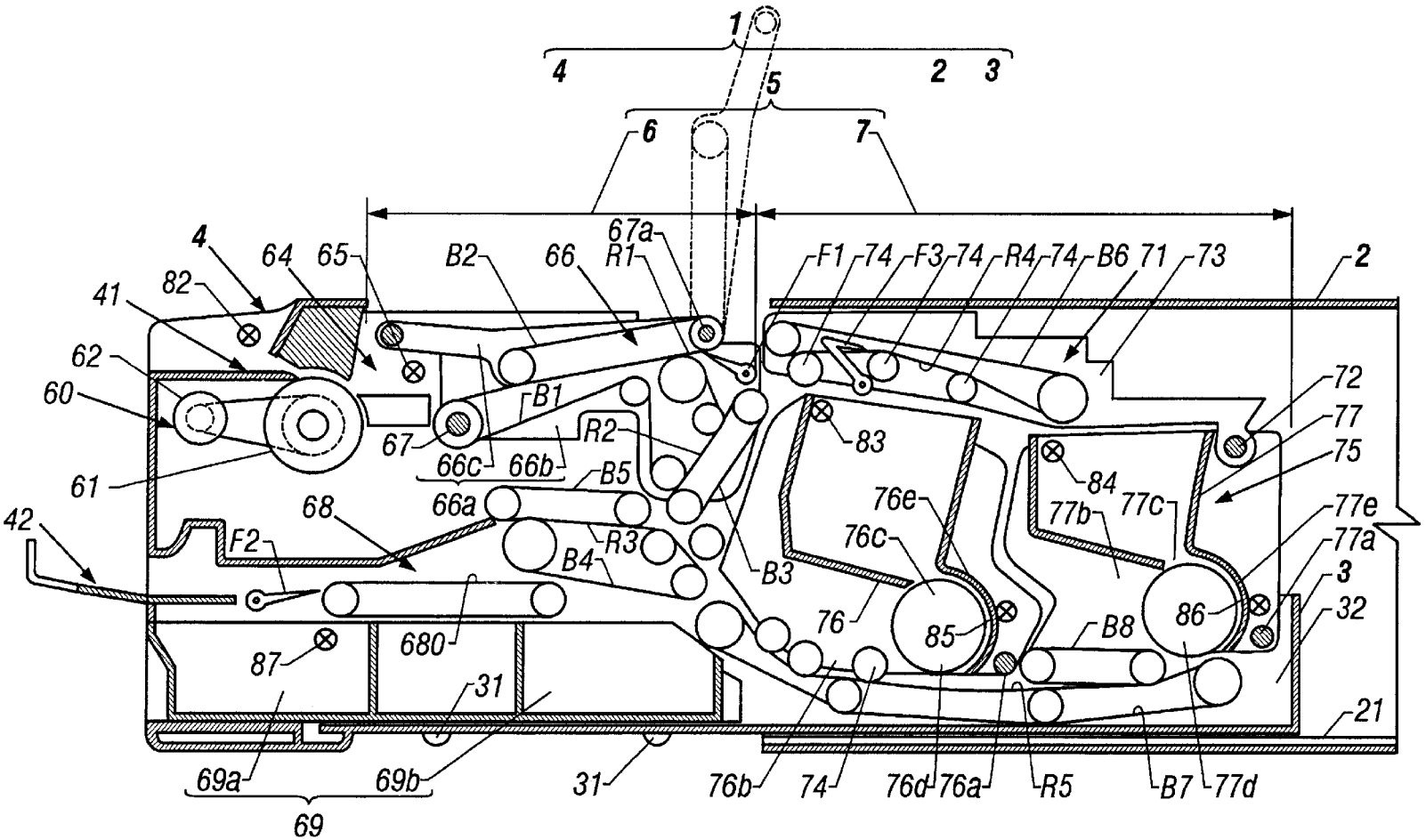
FIG. 4 is a side view in section of the note depositing/dispensing apparatus of FIG. 1, in which the depositing/dispensing mechanism is drawn from the casing up to a position where a first mechanism is exposed.
Figure 5:
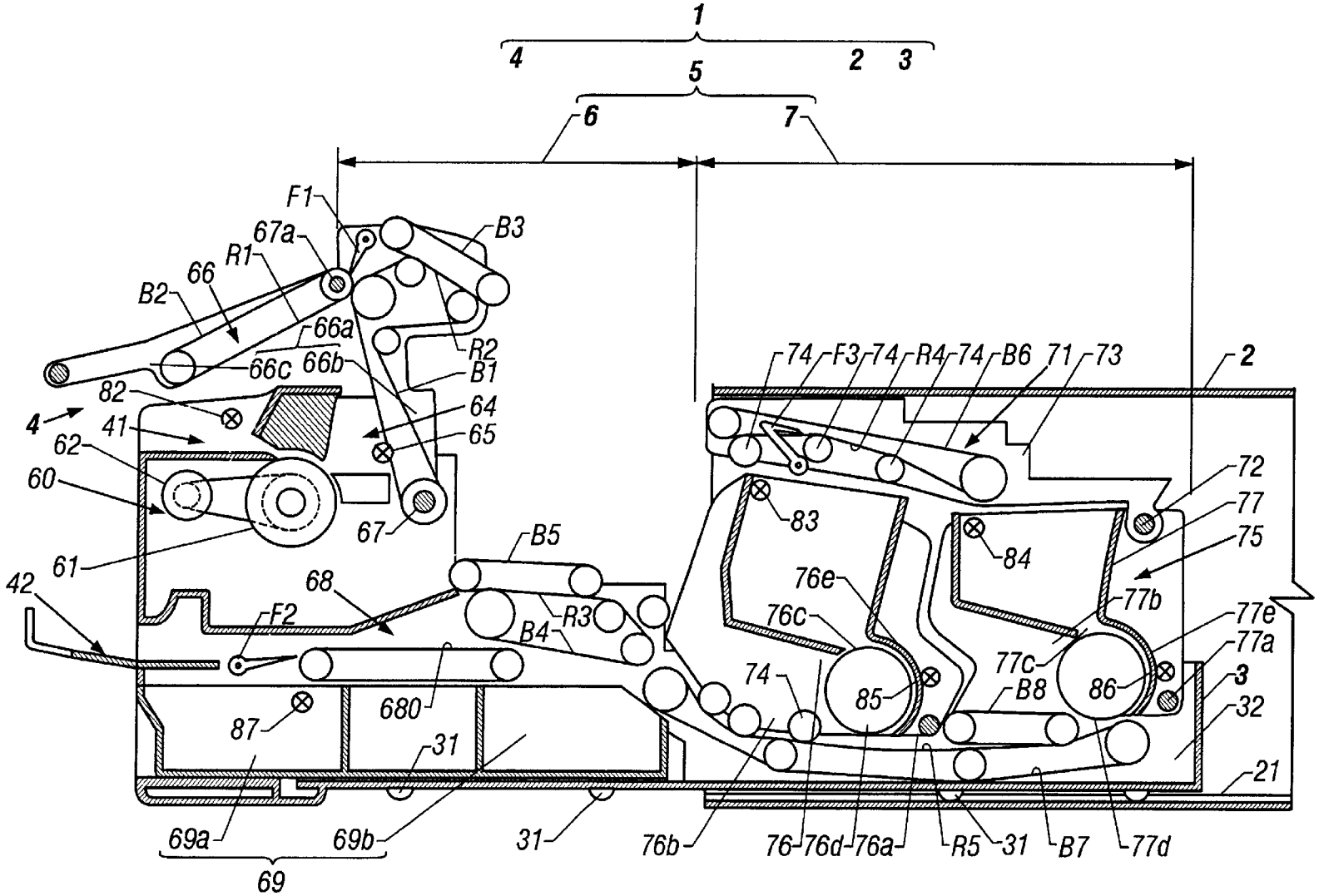
FIG. 5 is a side view in section of the note depositing/dispensing apparatus of FIG. 1, in which a first frame is fully open with the depositing/dispensing mechanism drawn.
Figure 6:
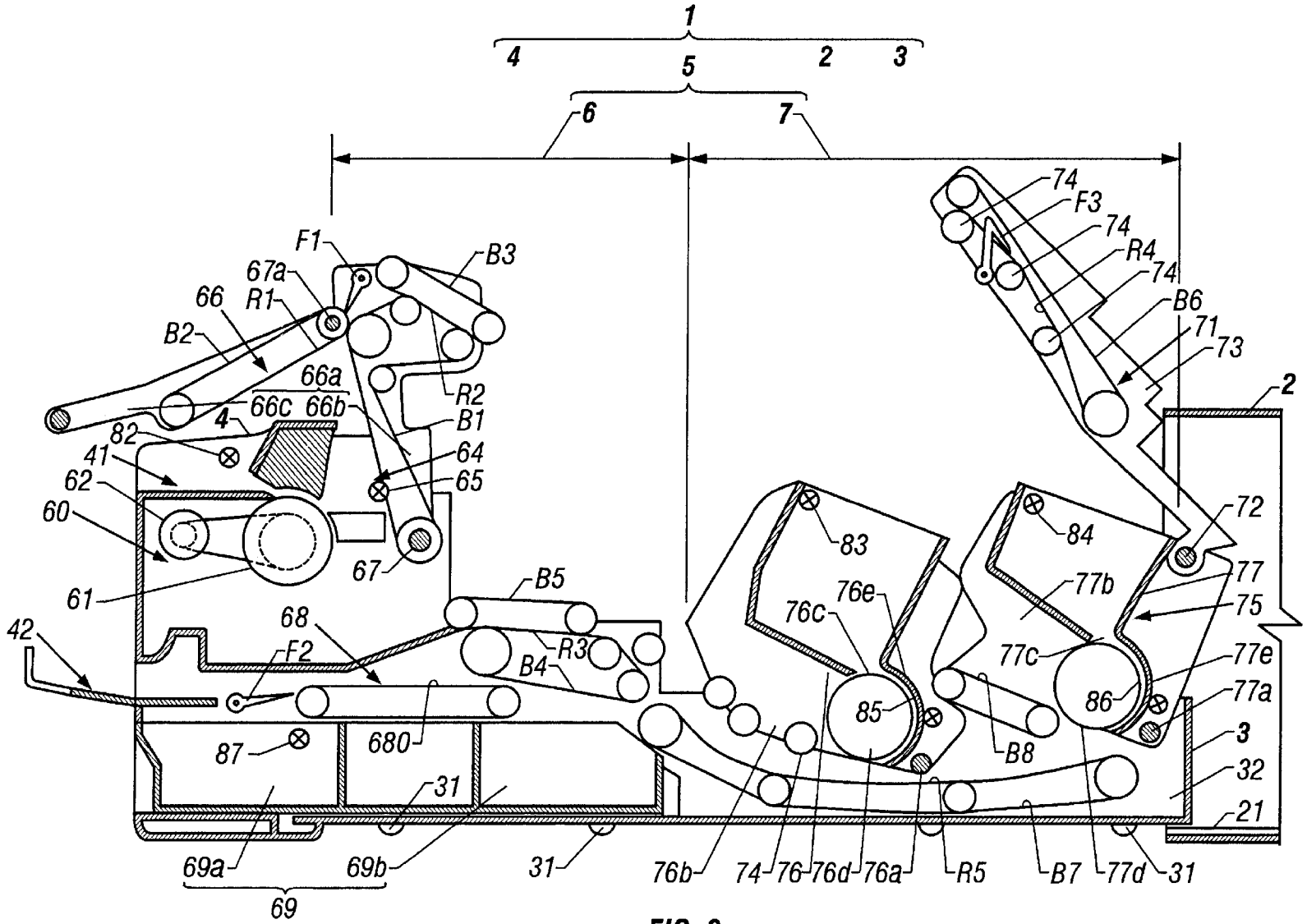
FIG. 6 is a side view in section of the note depositing/dispensing apparatus of FIG. 1, in which the depositing/dispensing mechanism is drawn from the casing up to a position where a second mechanism is exposed.

FIGS. 3 to 6 are side views in section of the note depositing/dispensing apparatus 1 of FIG. 1. FIG. 3 shows a state where the depositing/dispensing mechanism 5 is mounted in the casing 2; FIG. 4 shows a state where the depositing/dispensing mechanism 5 is drawn up to a position where the first mechanism 6 is exposed; FIG. 5 shows a state where a first frame 66*a* is fully open with the depositing/dispensing mechanism 5 drawn; and FIG. 6 shows a state where the depositing/dispensing mechanism 5 is drawn up to a position where the second mechanism 7 is exposed.

As shown in FIGS. 3 to 6, the first mechanism 6 is provided with a depositing portion 60 for separating the notes inserted through the note inlet 41 one by one and introducing them into the depositing/dispensing mechanism 5, a note type discriminator 64 for discriminating the types and genuineness of the inserted notes, a branched conveying assembly 66 for separately conveying the notes discriminated by the note type discriminator 64 toward the second mechanism 7 and toward the note collection box 69, and a dispensed note temporary storing portion 68 for feeding the notes dispensed from the second mechanism 7 to the note outlet 42 or the note collection box 69 after temporarily storing them.

The depositing portion 60 has a note feed roller 61 made of rubber. The notes inserted through the note inlet 41 are fed to the note type discriminator 64 by the rotation of the note feed roller 61. The note feed roller 61 is driven by a deposit feed motor 62. The roller 61 is provided with a note feed roller clutch 62*a*, and is switchingly rotated and stopped by the engagement and disengagement of this clutch.

The note type discriminator 64 includes a note discriminating sensor 65 provided in a position immediately downstream from the note feed roller 61 along a note transport path. This sensor 65 is constructed by an optical sensor or a magnetic sensor and discriminates the types and genuineness of the notes by detecting the characteristics of the notes.

The branched conveying assembly 66 is supported on the first frame 66*a*. The first frame 66*a* is comprised of a frame main body 66*b* mounted on a first horizontal shaft 67 extending between a pair of side plates 32 at the widthwise ends of the movable table 3 so as to be rotatable about the first horizontal shaft 67, and a pressing arm 66*c* mounted on a support shaft 67*a* extending along widthwise direction at a downstream end of the upper surface of the frame main body 66*b* so as to be rotatable about the support shaft 67*a*. By rotating in forward and reverse directions about the first horizontal shaft 67, the frame main body 66*b* is displaceable between a conveyance position where the conveyance path laterally extends and an inspection position where the frame main body 66*b* is held upright during an inspection such as when a note jam occurs. By rotating in forward and reverse directions about the support shaft 67*a*, the pressing arm 66*c* is also displaceable between a conveyance position where its lower surface faces the upper surface of the frame main body 66*b* and an inspection position where it extends substantially normal to the upper surface of the frame main body 66*b* as indicated by phantom line in FIG. 4.

The frame main body 66*b* has a hook-shape in side view, and first and second conveyance paths R1, R2 are formed on its upper and lower (right side of FIG. 3) surfaces, respectively, while being set in the conveyance position shown in FIG. 3. The first conveyance path R1 is formed by a first belt B1 mounted in L-shape on the frame main body 66*b* via a specified pulley and a second belt B2 which is so mounted on the pressing arm 66*c* as to face the first belt B1. With the frame main body 66*b* and the pressing arm 66*c* held in their conveyance positions, the first and second belts B1, B2 are rotated by driving an unillustrated drive motor while being held in contact with each other. Accordingly, notes held between the first and second belts B1, B2 are conveyed toward a downstream side along the first conveyance path R1.

The first belt B1 is so mounted as to vertically extend behind the frame main body 66*b* and, on the other hand, a third belt B3 which is opposed to and held in contact with the vertical extending portion of the first belt B1 is mounted on the frame main body 66*b*. The second conveyance path R2 is defined between the third and first belts B3, B1. A first flapper F1 is provided at the downstream end of the first conveyance path R1, and the note having reached the downstream end of the first conveyance path R1 is fed to either the second conveyance path R2 or the second mechanism 7 by a switching movement of the first flapper F1. In this embodiment, if the note is discriminated to be a $100-note or to be false by the discriminating sensor 65, it is fed to the second conveyance path R2. If, on the other hand, the note is discriminated to be a $10- or $50-note by the discriminating sensor 65, it is fed to the second mechanism 7.

The dispensed note temporary storing portion 68 is provided with a fourth belt B4 having an upstream end facing the downstream end of the second conveyance path R2 and also the downstream end of the second mechanism 7, a fifth belt B5 held in contact with an upper portion of the fourth belt B4, and a sorting belt 680 provided below the downstream ends of the belts B4, B5. A third conveyance path R3 is defined between the fourth and fifth belts B4, B5, and the notes conveyed along the first conveyance path R3 are supplied onto the sorting belt 680. The note collection box 69 is provided immediately below the sorting belt 680.

The note collection box 69 is a note collecting container for containing the collected notes inside, and is provided with a $100-note container 69*a* whose upper opening is located below the front end of the sorting belt 680 and a rejected note container 69*b* whose upper opening is located below the rear end of the sorting belt 680. The rejected note container 69*b* contains abnormal notes which were so-called false notes discriminated to be false by the discriminating sensor 65 or those which could not be discriminated to be genuine due to smears.

The sorting belt 680 has its direction of rotation set in accordance with the discrimination result of the discriminating sensor 65. The genuine note is conveyed forward by the counterclockwise rotation of the sorting belt 680, whereas the abnormal note is conveyed backward by the clockwise rotation of the sorting belt 680 to be stored in the rejected note container 69*b*.

A second flapper F2 is provided in front of the front end (left end in FIG. 3) of the sorting belt 680. The note being conveyed forward by the rotation of the sorting belt 680 can be stored in the $100-note container 69*a* or discharged to the outside through the note outlet 42.

The second mechanism 7 is comprised of a note sorting portion whose upstream end is located downstream from the first flapper F1 and a note storing portion 75 formed below the note sorting portion 71. The note sorting portion 71 includes a sorting frame 73 mounted on a rear upper portion of the note storing portion 75 rotatably about a second horizontal shaft 72. In the sorting frame 73 are provided a sixth belt B6 whose upstream end faces the first flapper F1, and three transport rollers 74 held substantially in contact with the lower surface of the sixth belt B6 at regular intervals. A fourth transport path R4 for conveying the note from the first mechanism 6 toward the note storing portion 75 is defined between the transport rollers 74 and the sixth belt B6.

Between the upstream transport roller 74 and the middle transport roller 74 is provided a third flapper F3. The note supplied to the fourth transport path R4 by the switching movement of the third flapper F3 is caused to drop down before the middle transport roller 74 or drop down at the downstream end of the sixth belt B6.

The note storing portion 75 is adapted to store deposited $10- and $50-notes, and includes a $10-note stocker 76 having an opening in its upper surface located below the fourth conveyance path R4 and a $50-note stocker 77 having an opening in its upper surface located below the downstream end of the fourth conveyance path R4. The stocker 76 is supported on a front stocker frame 76*b* rotatably mounted on a third horizontal shaft 76*a* extending between the side plates 32 of the movable table 3, whereas the stocker 77 is supported on a rear stocker frame 77*b* rotatably mounted on a fourth horizontal shaft 77*a*.

$10-notes branched off from the fourth conveyance path R4 by the third flapper F3 while being conveyed therealong are stored in the stocker 76. $50-notes conveyed to the downstream end of the fourth conveyance path R4 by switching the flapper F3 are stored in the stocker 77.

Note discharge openings 76*c*, 77*c* are formed in the rear side of the bottom wall of the respective stockers 76, 77, and note discharge rollers 76*d*, 77*d* are provided outside the note discharge openings 76*c*, 77*c*. The note discharge rollers 76*d*, 77*d* are driven by discharge motors 76*f*, 77*f*. The notes stored in the respective stockers 76, 77 are discharged by the rotation of the note discharge rollers 76*d*, 77*d*. Semicircular covers 76*e*, 77*e* extend from the respective note discharge openings 76*c*, 77*c* in such a manner as to cover the note discharge rollers 76*d*, 77*d*. Thus, the notes discharged through the note discharge openings 76*c*, 77*c* pass through clearances between the covers 76*e*, 77*e* and the note discharge roller 76*d*, 77*d* and are discharged outside after having their direction of conveyance reversed.

A seventh belt B7 is provided below the respective stocker frames 76*b*, 77*b*, and an eighth belt B8 is so provided below the rear stocker frame 77*b* as to be held in contact with the seventh belt B7. Further, a specified number of transport rollers 74 are provided below the front stocker frame 76*b* such that their circumferential surfaces are held in contact with the seventh belt B7. A fifth conveyance path R5 for conveying the notes toward the third conveyance path R3 is defined between the transport rollers 74 and the eighth belt B8, and the seventh belt B7.

Accordingly, $50-notes discharged from the stocker 77 are conveyed toward the third conveyance path R3 along the fifth conveyance path R5 while being guided by the rotation of the seventh and eighth belts B7, B8 and the transport rollers 74. Further, $10-notes discharged from the stocker 76 are conveyed toward the third conveyance path R3 along the fifth conveyance path R5 while being guided by the rotation of the seventh belt B7 and the transport rollers 74. When the notes are dispensed from the stockers 76, 77, the second flapper F2 provided before the sorting belt 680 is switched such that the conveyance path for the notes communicates with the note outlet 42. Therefore, the dispensed notes are conveyed to the note outlet 42 via the third conveyance path R3 and the sorting belt 680.

Figure 7A:
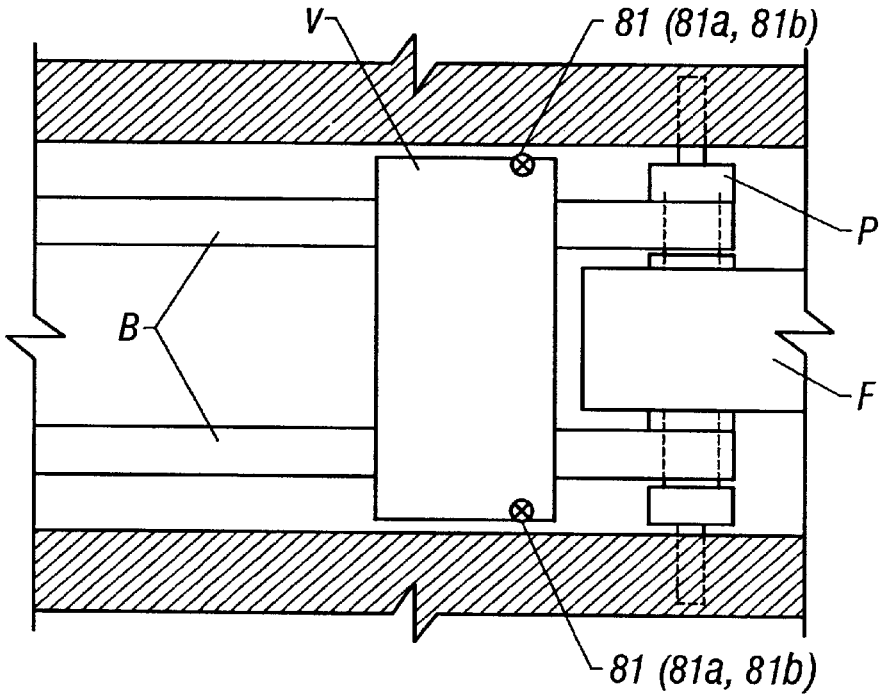
Figure 7B:
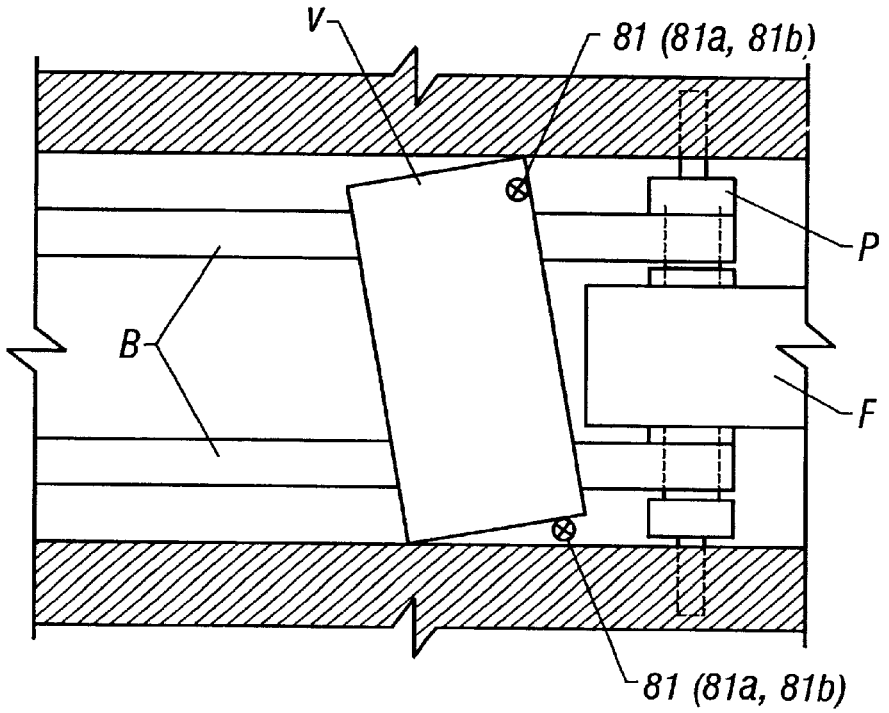

Next, detection of jamming of a note being conveyed along the respective conveyance paths R1 to R5 is described. FIGS. 7A and 7B are plan diagrams of the belts conveying a note, wherein FIG. 7A shows a proper conveyance of the note and FIG. 7B shows an occurrence of a note jam. As shown in FIGS. 7A and 7B, the belts B (first to eighth belts B1 to B8) for conveying notes V are mounted between pulleys in specified positions in the depositing/dispensing mechanism 5. Each belt B is comprised of two pairs of upper and lower belt members having conveying surfaces held in contact with each other. The note V is stably conveyed while being tightly held between the upper and lower belt members. For the sake of convenience, only the lower belts are shown in FIGS. 7A and 7B. The two corresponding belt members are mounted on pulleys so as to ensure a specified spacing therebetween. This spacing is provided to, for example, allow the insertion of the leading end of the flappers F1 to F3 for changing the conveyance path.

Jam sensors 81 are provided in the inner wall surfaces at the opposite sides of the belts B thus constructed. Each jam sensor 81 is comprised of a light emitting element and a light receiving element which are vertically opposed to each other, i.e., a so-called optical sensor. If the note V is conveyed on the belt B while being properly oriented, the respective ends of the note V interfere optical paths between the light emitting elements and the light receiving elements of the optical sensors when the note V reaches the jam sensors 81. This interference is cleared when the note V passes the jam sensors 81 after the elapse of a predetermined time. In this embodiment, no occurrence of a note jam is detected by clearing the interference after the elapse of the predetermined time following the start of the interference of the note with the jam sensors 81.

On the other hand, if the note V is conveyed while being obliquely oriented in plan view and come into contact with the inner wall surfaces of the conveyance path to cause a note jam as shown in FIG. 7B, the interference of the optical path is not cleared even after the elapse of the predetermined time following the detection of the note V by the jam sensors 81. In this way, an occurrence of a note jam is detected. In an example shown in FIG. 7B, the optical path of the left (upper in the plane of FIG. 7B) jam sensor 81 is interfered by the jammed note V, and this interference is not cleared even after the elapse of the predetermined time. Thus, a note jam is detected.

Since the note V being conveyed interferes the optical path of the jam sensor 81, the light from the light emitting element does not reach the light receiving element, with the result that the note jam is detected. The interference of the optical path by the note V for longer than the predetermined time does not necessarily mean an occurrence of a note jam, but indicates it with a high possibility. Therefore, the note jam is detected at this stage in order to prevent a possible note jam.

A suitable number of the jam sensors 81 are provided in specified positions along the first to fifth conveyance paths R1 to R5, and the driving of the belts B is entirely stopped upon the occurrence of a note jam, so that the note jam can be easily and quickly dealt with. In this embodiment, first jam sensors 81*a* are provided in the first mechanism 6, and second jam sensors 81*b* are provided in the second mechanism 7. The confirmation lamp 47*e* (see FIG. 1) blinks when the first jam sensor 81*a* detects a note jam, whereas the non-confirmation lamp 47*d* blinks when the second jam sensor 81*b* detects a note jam. In this way, whether the note jam has occurred in the first mechanism 6 or in the second mechanism 7 can be confirmed.

Figure 8:
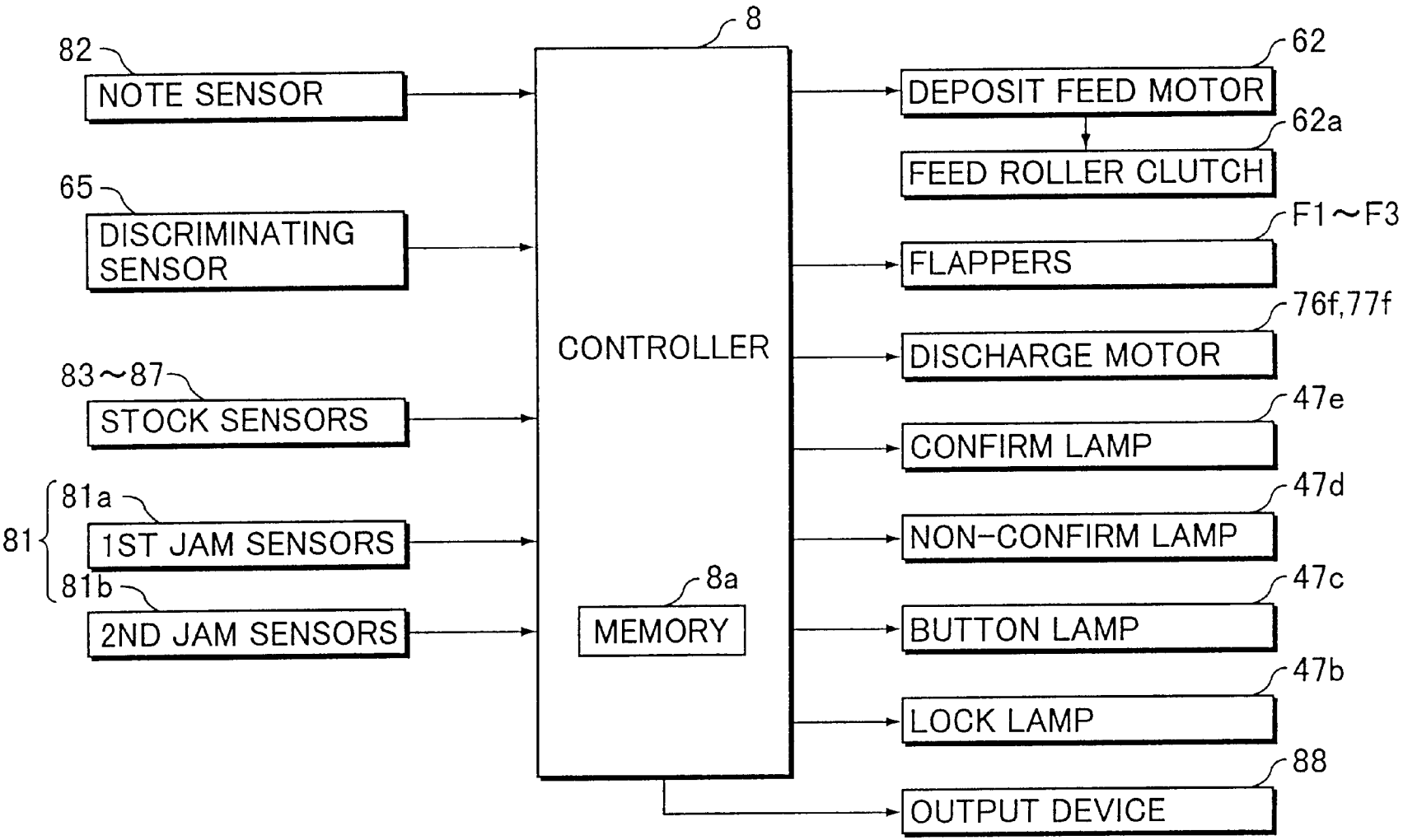
FIG. 8 is a block diagram showing a jam removing by a controller.

FIG. 8 is a block diagram showing a jam removing by a controller. A controller 8 including a microprocessor is built in a specified position of the note depositing/dispensing apparatus 1. When a note sensor 82 provided at the note inlet 41 detects the presence of a note (see FIG. 1), the controller 8 sends a control signal to drive the deposit feed motor 62, thereby driving the note feed roller 61. The note is introduced into the depositing/dispensing mechanism 5 by the rotation of the roller 61, has its type and genuineness discriminated, and is conveyed to a specified storing portion by a control signal outputted from the controller 8 to the flappers F1 to F3 based on the discrimination result. Upon a dispensing command, the controller 8 outputs a control signal to the discharge motors 76*f*, 77*f* to drive the note discharge roller 76*d*, 77*d* of the specified stocker 76, 77 to dispense the note(s). In this way, the controller 8 controls the entire operation of the note depositing/dispensing apparatus 1.

In this embodiment, a $10-note sensor 83 is provided in a specified position of the $10 note stocker 76, and a $50-note sensor 84 is provided in a specified position of the $50 note stocker 77. Upon the detection of the sensor 83, the storage of a $10-note in the stocker 76 is notified to the controller 8. Upon the detection of the sensor 84, the storage of a $50-note in the stocker 77 is notified to the controller 8. Further, a $100-note sensor 87 is provided in a specified position of the $100 note container 69*a* of the note collection box 69, and the detection of this sensor 87 is also notified to the controller 8.

Further, a $10-note discharge sensor 85 is provided in vicinity of the note discharge opening 76*c* of the $10-note stocker 76, and a $50-note discharge sensor 86 is provided in vicinity of the note discharge opening 77*c* of the $50-note stocker 77. The note type and total amount of the dispensed notes is known by the detection of the sensors 85, 86.

The controller 8 includes a depositing/dispensing processor, which calculates a balance based on the detection results of the stock sensors 83, 84 and those of the discharge sensors 85, 86. The calculated balance is stored in a memory 8a provided in the controller 8, and is outputted by an output device 88 if necessary.

In this embodiment, detection signals from the first and second jam sensors 81*a*, 81*b* are also inputted to the controller 8. After discriminating whether the received detection signal is from the sensor 81*a* or 81*b*, a control signal is outputted to a specified section of the display unit 47 to blink a corresponding lamp.

Specifically, upon the input of the detection signal from the first jam sensor 81*a*, a control signal is so outputted as to cause the button lamp 47*c* to blink (occurrence of a jam in the first mechanism 6). On the other hand, upon the input of the detection signal from the second jam sensor 81*b*, a control signal is so outputted as to cause the lock lamp 47*b* to blink (occurrence of a jam in the second mechanism 7). In this way, the operator can confirm whether the note jam has occurred in the first or second mechanism 6 or 7 of the depositing/dispensing mechanism 5.

Further, the first jam sensor 81*a* is sectioned into a button processing sensor for detecting a jam before the note type and the amount are not detected by the note discriminating sensor 65 and a key processing sensor for detecting a jam after the note type and the amount are detected by the note discriminating sensor 65. The button lamp 47*c* blinks when the button processing sensor of the first jam sensor 81*a* detects a jam, whereas the lock lamp 47*b* blinks when the key processing sensor of the first jam sensor 81*a* detects a jam.

Similarly, the second jam sensor 81*b* is sectioned into a button processing sensor and a key processing sensor. The button lamp 47*c* blinks when the button processing sensor of the second jam sensor 81*b* detects a jam, whereas the lock lamp 47*b* blinks when the key processing sensor of the second jam sensor 81*b* detects a jam.

More specifically, when the confirmation lamp 47*e* blinks, the note jam has occurred after the balance was calculated, i.e., the calculation result of the balance stored in the memory 8*a* coincides with the note types and amount stored in the depositing/dispensing mechanism 5 (i.e., in a registered state). On the other hand, when the non-confirmation lamp 47*d* blinks, the note jam has occurred before the deposited or dispensed note was registered. How the jammed note should be handled depending on the situation when the note jam occurred is as described with reference to TABLE-1.

The movable table 3 is normally locked so as not to be drawn from the casing 2. There are provided a first locking device for enabling the movable table 3 to be drawn up to a position where the first mechanism 6 is exposed to the outside by pushing the table drawing enabling button 44, and a second locking device for enabling the movable table 3 to be drawn up to a position where the second mechanism. 7 is exposed to the outside by inserting the key into the keyhole 45 to effect unlocking.

Figure 9B:
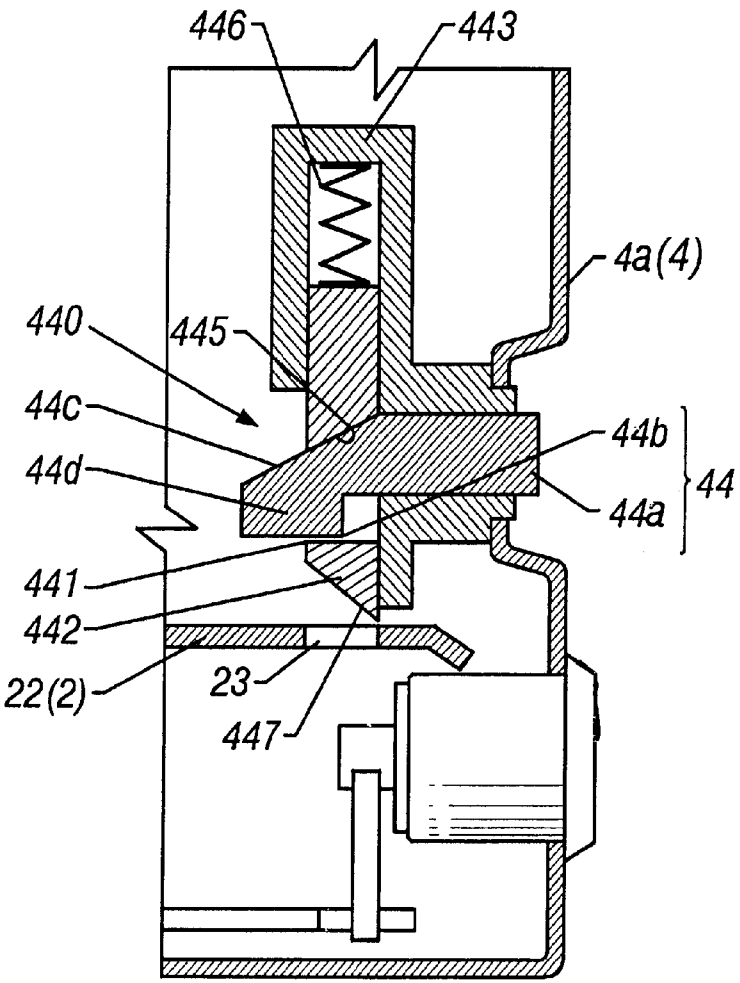
Figure 9A:
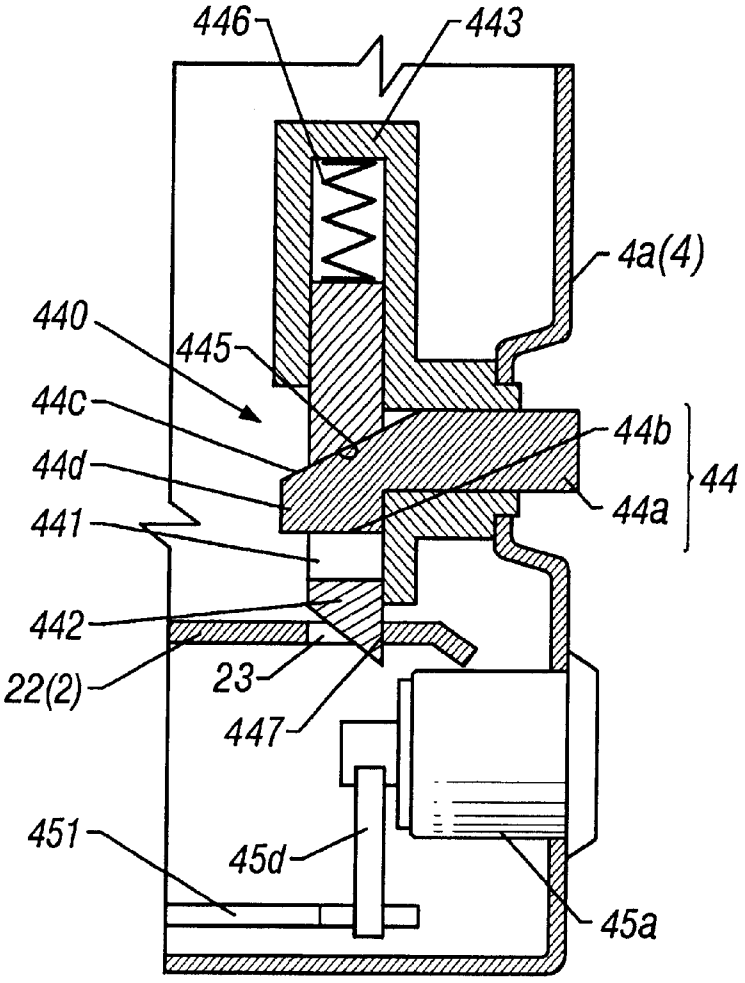

FIGS. 9A and 9B are plan views in section showing the first locking device, wherein FIG. 9A shows a state where the movable table 3 is locked so as not to be drawn and FIG. 9B shows a state where the movable table 3 is unlocked. As shown in FIGS. 9A and 9B, the first locking device 440 includes a cylinder 441 fixed to a specified position of the rear surface of the front plate of the movable table 3, the table drawing enabling button 44 provided in the cylinder 441 slidably along forward/backward directions, and a tongue portion 442 which slides in a direction normal to a moving direction of the button 44 as the button 44 is moved forward and backward. The cylinder 441 has a tongue portion holding tube 443 fixed such that its opening faces the front end of the cylinder 441. The tongue portion 442 is fitted in slidable contact with the tongue portion holding tube 443 such that it can reciprocate along widthwise direction.

The button 44 is comprised of a cylindrical button portion 44*a* and a pyramidal portion 44*b* projecting backward from the rear end of the button portion 44*a*. The button portion 44*a* is fitted in the cylinder 441 in slidable contact therewith and movable forward and backward therein. On the other hand, the pyramidal portion 44*b* is tapered toward its leading end, and a slanted portion 44*c* is formed on the right side and a projecting portion 44*d* projecting to the left is formed on the left side. The button 44 is prevented from coming out forward by the interference of the base end of the projecting portion 44*d* with the leading edge of the cylinder 441.

A link hole 444 penetrating, along forward and backward directions, a middle portion of the tongue portion 442 with respect to widthwise direction, and the button 44 and the tongue portion 442 are linked with each other by inserting the pyramidal portion 44*b* of the button 44 through the link hole 444. The link hole 444 has a width larger than that of the pyramidal portion 44*b*, and is formed on its right inner wall surface with a slanted surface 445 inclined at the same angle as the slanted portion 44*c* of the button 44. The tongue portion 442 formed with such a link hole 444 is biased to the left by a compression spring 446 mounted in the tongue portion holding tube 443. Accordingly, the button portion 44*a* of the button 44 having the slanted portion 44*c* held in contact with the slanted surface 445 of the tongue portion 442 projects out through the panel portion 4 upon receiving a forward acting force resulting from a biasing force of the compression spring 446.

A slanted surface 447 is formed at a front side of the left end (lower end in FIGS. 9A and 9B), and the side plate 22 of the casing 2 is formed with a lock hole 23 which corresponds to the left end of the tongue portion 442 when the movable table 3 is accommodated in the casing 2. The movable table 3 is locked and accommodated in the casing 2 as shown in FIG. 9A by fitting the left end of the tongue portion 442 into the lock hole 23.

Accordingly, if the button portion 44*a* of the table drawing enabling button 44 is pushed by a finger in the state shown in FIG. 9A, the pyramidal portion 44*b* is moved forward and the slanted portion 44*c* of the pyramidal portion 44*b* accordingly pushes the slanted surface 445 of the tongue portion 442 to the right against the biasing force of the compression spring 446, with the result that the tongue portion 442 is moved to the right. By the rightward movement of the tongue portion 442, the left end thereof is disengaged from the lock hole 23 as shown in FIG. 9B, releasing the locking by the first locking device 440. The movable table 3 can be drawn from the casing 2 by pulling the panel portion 4 forward (downward in the plane of FIGS. 9A and 9B) in this unlocked state.

When the drawn movable table 3 is moved toward the casing 2, the slanted surface 447 at the left end of the tongue portion 442 comes into contact with the edge of the side plate 22 of the casing 2. If a larger force is exerted to push the movable table 3 in this state, the tongue portion 442 is guided to the slanted surface 447 in contact with the edge of the side plate 22 and moved to the right against the biasing force of the compression spring 446. Then, the left end of the tongue portion 442 is fitted into the lock hole 23 of the casing 2 again after the movable table 3 is pushed into the casing 2. As a result, the movable table 3 is locked by the first locking device 440 as shown in FIG. 9A.

Figure 10A:
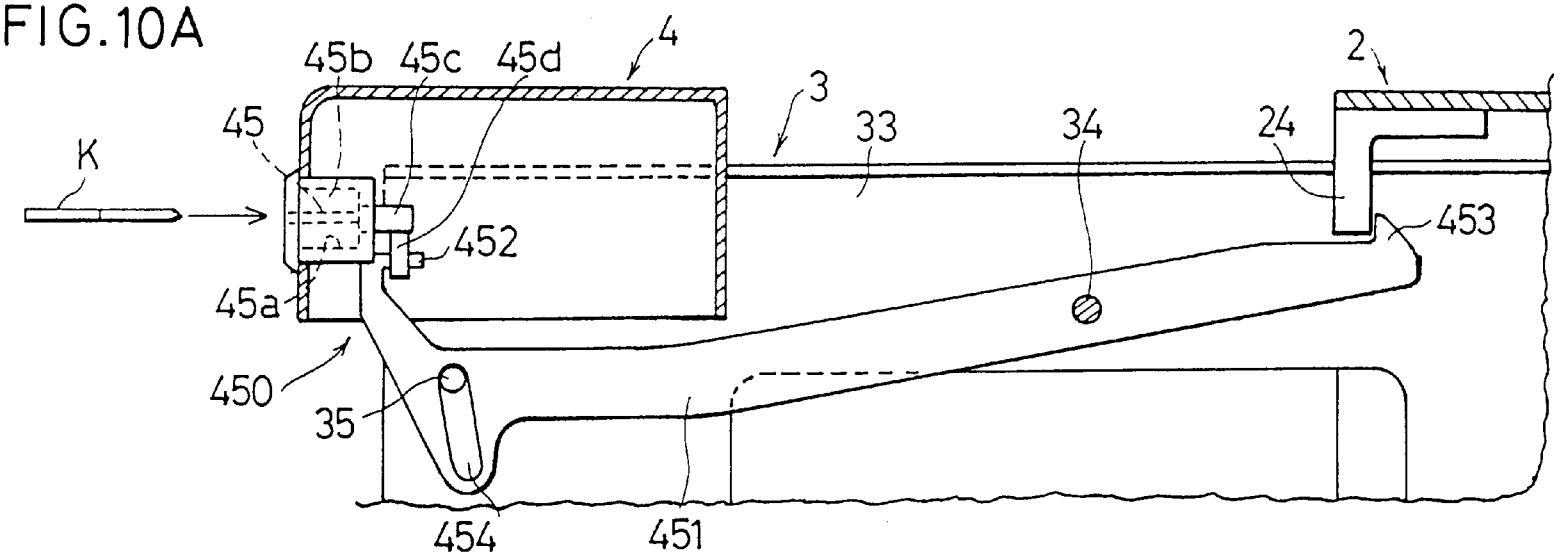
Figure 10B:
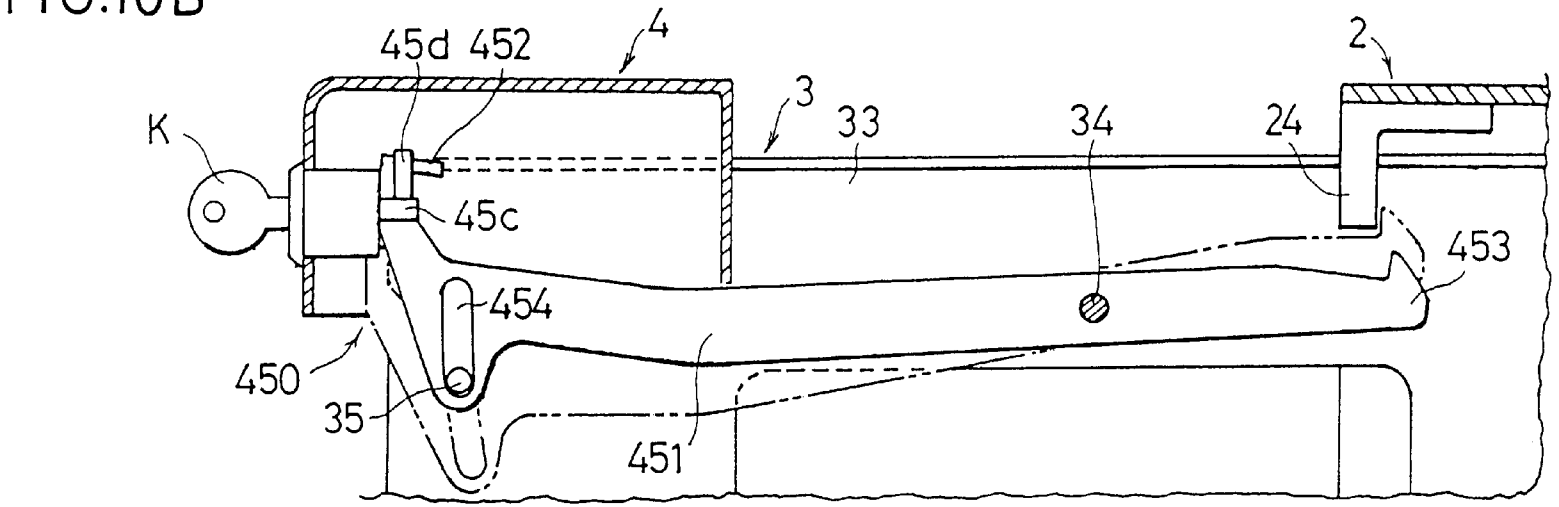

FIGS. 10A and 10B are plan views in section showing the second locking device, wherein FIG. 10A shows a state where the movable table 3 is locked so that it cannot be drawn from the first drawing position, and FIG. 10B shows a state where the above locking is released. As shown in FIGS. 10A and 10B, the second locking device 450 is comprised of a lock bar 451 provided on a bottom plate 33 of the movable table 3, an engaging piece 24 provided on the casing 2 to be engaged with and disengaged from the lock bar 451, and a locking cylinder 45*a* provided with the keyhole 45 for engaging and disengaging the lock bar 451 with and from the engaging piece 24.

The lock bar 451 is elongated along forward and backward directions, and has its substantially middle portion rotatably supported about a vertical shaft 34 projecting upward from the bottom plate 33 of the movable table 3 while its front end (left end in FIGS. 10A and 10B) is facing the rear end of the cylinder 45*a*. A locking hook 452 which projects toward the rear end of the cylinder 45*a* is provided at the front end of the lock bar 451, and a locking claw 453 engageable with the engaging piece 24 is provided at the rear end thereof. An arcuate oblong hole 454 extending along a trace of rotation of the lock bar 451 about the vertical shaft 34 is formed at a front part of the lock bar 451. On the other hand, a rotation restricting shaft 35 fittable into the oblong hole 454 is formed in the bottom plate 33 of the movable table 3. The rotation of the lock bar 451 about the vertical shaft 34 is restricted by fitting the rotation restricting shaft 35 into the oblong hole 454 in sliding contact therewith.

On the other hand, a cylindrical rotary member 45*b* is so fitted in the cylinder 45*a* as not to come out with the outer circumferential thereof held in sliding contact with the inner surface of the cylinder 45*a*. A projection 45*c* projects out from the rear end of the rotary member 45*b* through a bottom plate of the cylinder 45*a*, and an engaging piece 45*d* engageable with the locking hook 452 of the lock bar 451 projects downward from the projection 45*c*.

The keyhole 45 is so formed as to extend backward from the front end surface of the rotary member 45*b*. Accordingly, the rotary member 45*b* is rotated about an axis of rotation by inserting a specified key K into the keyhole 45 and rotating it. This causes the engaging piece 45*d* to rotate about the projection 45*c*, and the lock bar 451 is rotatable in forward and backward directions about the vertical shaft 34 via the locking hook 452 engaged with the engaging piece 45*d*.

In the second locking device 450 thus constructed, since the rear end of the lock bar 451 is normally slanted toward the engaging piece 24 of the casing 2, the locking claw 453 of the lock bar 451 is engaged with the engaging piece 24 of the casing 2 as shown in FIG. 10A in a state where the movable table 3 is drawn from the casing 2 up to the first drawing position. Therefore, the movable table 3 cannot be drawn any further.

In this state, the key K is inserted into the keyhole 45 of the cylinder 45*a* of the panel portion 4 as indicated by an arrow in FIG. 10A and is rotated clockwise with respect to the front surface (left surface in FIGS. 10A and 10B) of the panel portion 4, thereby rotating the engaging piece 45*d* clockwise via the rotary member 45*b* and the projection 45*c*. Accordingly, the locking hook 452 of the lock bar 451 engaged with the engaging piece 45*d* is moved to the left (upward in the planes of FIGS. 10A and 10B). Then, the locking claw 453 is disengaged from the engaging piece 24 by the clockwise rotation of the lock bar 451 about the vertical shaft 34. As a result, the movable table 3 can be drawn up to the second drawing position as shown in FIG. 10B.

The first locking device 440 is unlocked by pushing the table drawing enabling button 44 upon the occurrence of a note jam in the first mechanism 6. Thus, by pulling the grip 42*a* by fingers forward while pushing the button 44, the movable table 3 is drawn up to the first drawing position, thereby exposing the first mechanism 6. Therefore, the jammed note can be removed by opening the first frame 66*a* as shown in FIG. 5.

Upon the occurrence of a note jam in the second mechanism 7, the second locking device 450 is unlocked by inserting the key K into the keyhole 45 and turning it in a specified direction, thereby enabling the movable table 3 to be drawn up to the second drawing position where the second mechanism 7 is exposed. Thus, the note jammed in the conveyance path can be removed by opening the sorting frame 73, the front stocker frame 76*b* and the rear stocker frame 77*b* as shown in FIG. 6.

Figure 11:
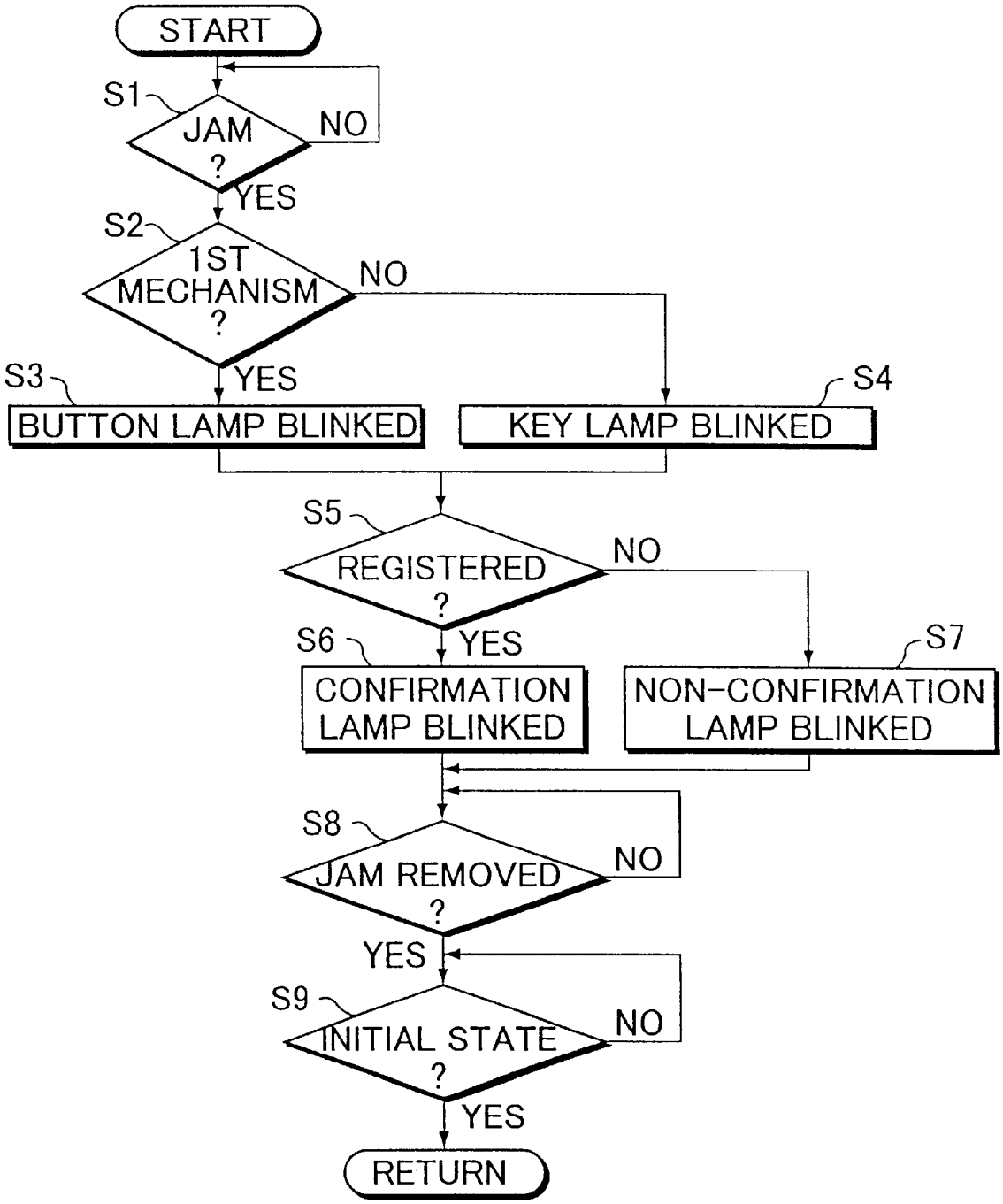
FIG. 11 is a flowchart showing a jam removing control executed upon the occurrence of a note jam.

FIG. 11 is a flowchart showing one embodiment of a jam removing control executed upon the occurrence of a note jam. First, it is discriminated whether the jam sensor 81 has detected the occurrence of the note jam (Step S1). Upon detecting the note jam, it is discriminated based on the detection signal from the jam sensor 81 whether the position of jamming is located in the first mechanism 6 (Step S2). If the discrimination result is affirmative in Step 2, i.e., jamming has occurred in the first mechanism 6, the button lamp 47*c* is blinked (Step S3). Conversely, if the discrimination result is negative in Step 2, i.e., jamming has occurred in the second mechanism 7, the key lamp 47*b* is blinked (Step S4).

Subsequently, in Step S5, it is discriminated whether the detection signal is from the jam sensor 81 to judge whether the deposited or dispensed note has been already registered. The non-confirmation lamp 47*d* is blinked (Step S6) unless the note is registered, whereas the confirmation lamp 47*e* is blinked (Step S7) if the note is registered. The operator can confirm the situation of the note jam by seeing the blinking state of the display unit 47. After the jammed note removing operation shown in TABLE-1 above is performed, it is discriminated whether the jammed note has been removed (Step S8). If the jammed note has already been removed, it is discriminated whether the note depositing/dispensing apparatus 1 has been brought into its initial state (Step S9). If so, the control is returned to START.

In this embodiment, the depositing/dispensing mechanism 5 includes the first mechanism 6 for holding the deposited or dispensed notes having not yet counted for a balance, and the second mechanism 7 for holding the deposited or dispensed notes having registered. The first and second mechanisms 6, 7 are, respectively, provided at the front and rear parts of the movable table 3 with respect to the drawing direction. Accordingly, if a note jam occurs in the conveyance path in the depositing/dispensing mechanism 5, the jammed note can be removed after the movable table 3 is drawn from the casing 2 up to the position where the first mechanism 6 is exposed when the position of jamming is in the first mechanism 6. The jammed note is removed after the movable table 3 is drawn up to the position where the second mechanism 7 is exposed only when the position of jamming is in the second mechanism 7.

Upon the occurrence of the note jam in the first mechanism 6, the jammed deposited note has not been counted for the balance calculated by the controller 8, i.e., has not been registered. Thus, the note removed from the position of jamming is fed to the entrance of the conveyance path again after the movable table 3 is accommodated in the casing 2. Further, upon the occurrence of the note jam in the second mechanism 7, the jammed deposited note has been counted for the balance calculated by the controller 8. Thus, the movable table 3 is entirely drawn from the casing 2 to expose the second mechanism 7, and the note removed from the position of jamming is stored in the note storing portion of the second mechanism 7.

As described above, the depositing/dispensing mechanism 5 installed on the movable table 3 is comprised of the first and second mechanism 6, 7 provided at the front and rear portions of the movable table 3, and the note deposited right now and thus not yet counted for the balance calculated by the controller 8 is held in the first mechanism 6 while the note counted for the balance is held in the second mechanism 7. Accordingly, the register operator can handle a slight note jam occurred immediately after the depositing by removing the jammed note after drawing the movable table 3 from the casing 2 such that only the first mechanism 6 is exposed and by feeding the removed note again to the first mechanism after the movable table 3 is pushed back into the casing 2. Therefore, an inconvenience to let customers wait for a long time can be solved. Further, the slight note jam can be handled without exposing the second mechanism 7 containing many notes to the outside, which brings about a big advantage in view of security.

The movable table 3 may be entirely drawn to expose the second mechanism 7 only when the note jam occurs after the calculation of the balance is completed. The second mechanism 7 is adapted to sort out the notes fed from the first mechanism 6 and store the sorted notes in the specified note storing portion 75, and has a simple construction accordingly. Thus, the second mechanism 7 is exposed to the outside due to the note jam with a small frequency, which is advantageous in view of security. In addition, a special means such as the use of the key K administered by an administrator is needed to expose the second mechanism 7. This makes the note depositing/dispensing apparatus 1 very safe in view of security.

The present invention is not limited to the above, but may embrace the following embodiments.

(1) Although the note depositing/dispensing apparatus 1 is described as a money handling apparatus in the foregoing embodiment, the present invention is not limited to the note depositing/dispensing apparatus, but is also applicable to a so-called note depositing apparatus which is exclusively used for storing the deposited notes without dispensing upon request, and in which the stored notes are taken out at specified intervals. Such an apparatus can be used to deposit the sale of a taxi driver at the nighttime or to deposit the money collected by a delivery person at the nighttime. The note depositing apparatus is constructed such that a receipt printed with an amount of deposit is issued at the same time depositing is completed, and an operator can prove the deposit by presenting this receipt.

(2) In the foregoing embodiment, the jammed note V interferes the optical path of the jam sensor 81 and the note jam is detected when this interference lasts for the predetermined time. In addition to such a jam detecting method, the following jam removing method can be adopted. Specifically, when the note V is conveyed by the belt B while being obliquely oriented as shown in FIG. 7B, after the optical path of one jam sensor 81 is interfered, that of the other jam sensor 81 is interfered with a specified lag. If the note V is considerably inclined, this time lag is longer. Accordingly, an angle of inclination of the note V is detected by measuring this time lag, the belt B may be rotated in the reverse direction after being stopped and the note V may be discharged to the outside through the note inlet 41 if the note V is excessively inclined. This arrangement prevents a possible note jam. The note V returned to the note inlet 41 may be fed through the note inlet 41 again after having its creases smoothed out.

Figure 12:
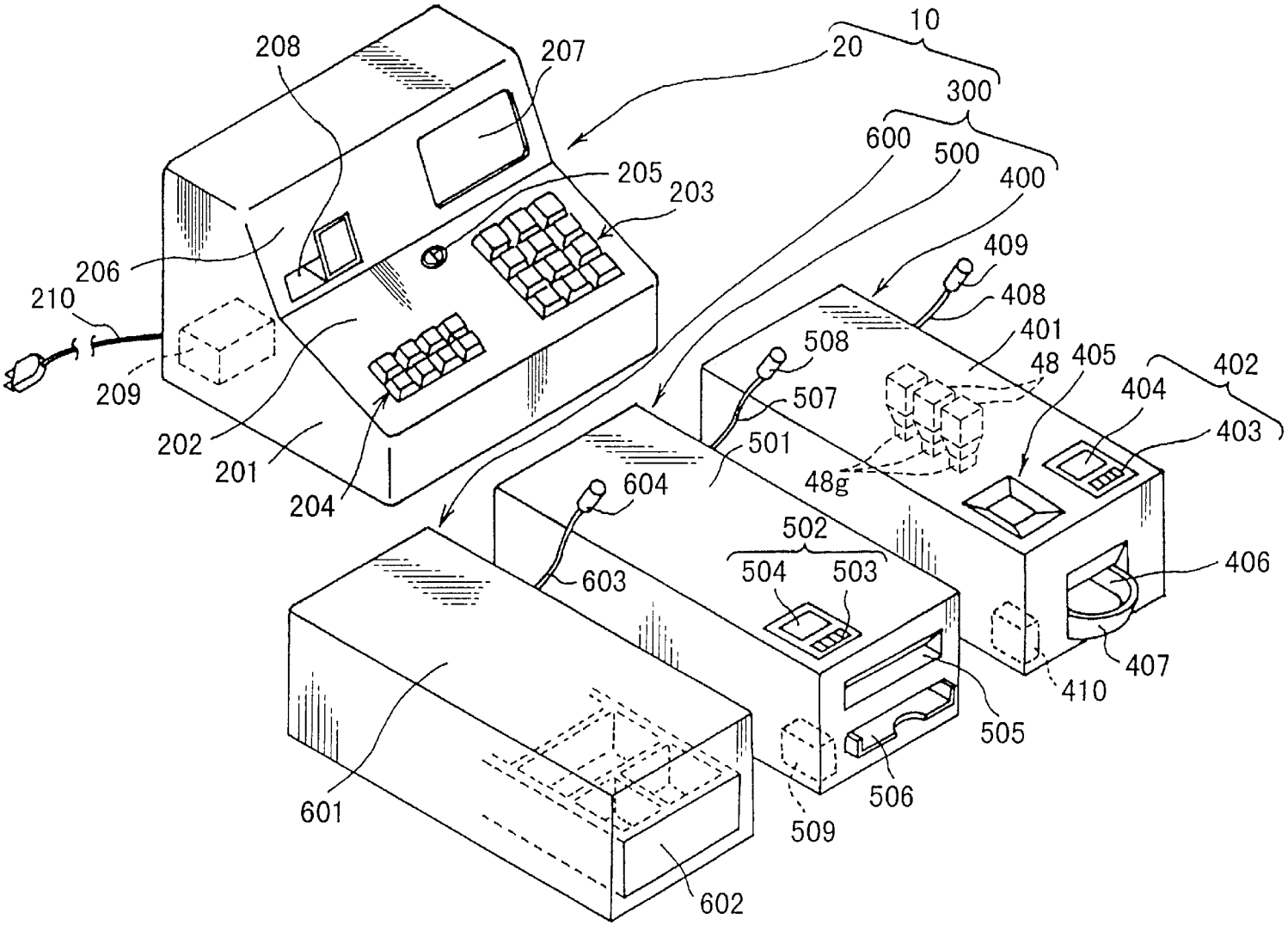
FIG. 12 is an exploded perspective view showing a money accounting machine according to an embodiment of the invention.

FIG. 12 is an exploded perspective view of a money accounting machine according to an embodiment of the invention. In this embodiment, an inventive note depositing/dispensing apparatus is used as one component of a money accounting machine for collectively handling coins and notes. Specifically, as shown in FIG. 12, a money accounting machine 10 is comprised of an electronic cash register 20, and three types of money handling apparatuses 300, two of which are selectively connected with the cash register 20. The money handling apparatuses 300 include a coin depositing/dispensing apparatus 400, a note depositing/dispensing apparatus 500 and a money storing apparatus 600. The note depositing/dispensing apparatus 500 of this embodiment corresponds to the one of the foregoing embodiment, and has an outer configuration slightly different from the latter although it is basically identical to the latter.

The respective elements of this money accounting machine 10 is described in detail. The cash register 20 is constructed by installing specific electronic devices in a casing 201 which has a stepped front part which is inclined downward toward the front end, i.e., has a deformed box shape. An operation panel 202 formed on the front upper surface of the casing 201 is provided with an amount input portion 203 in which ten number entry keys are arranged, and an operation input portion 204 in which various control and/or operation input keys are arranged. Further, a keyhole 205 is provided in the upper middle of the panel 202. A registration mode, a setting mode, an inspection mode and a settlement mode of the cash register 20 are switchingly set by inserting an unillustrated key into the keyhole 205 and operating it.

An output panel 206 is formed on a forward facing slanted surface of the casing 201 behind the operation panel 202. On the right side of the output panel 206 is provided a display 207 for displaying a numerical value of an amount inputted by using the amount input portion 203, etc. On the left side of the output panel 206 is provided a receipt issuance opening 208 for issuing a receipt printed with an inputted amount, a change, etc.

Based on the input data from the amount input portion 203 and the operation input portion 204, the coin depositing/dispensing apparatus 400, the note depositing/dispensing apparatus 500 or the money storing apparatus 600 used in combination with the cash register 20 perform a specified operation necessary for depositing or dispensing. First to third type of money accounting machines 11, 12, 13 to be described later fulfill their own functions based on the combination of the cash register 20 with the apparatuses 400, 500 and/or 600.

In order to fulfill the above functions, a central controller 209 including a microcomputer is built in the cash register 20, and a coin controller 410 and a note controller 509 are built in the coin depositing/dispensing apparatus 400 and the note depositing/dispensing apparatus 500, respectively. Change information is outputted from the central controller 209 to the coin and note depositing/dispensing apparatuses 400, 500. Upon the receipt of the change information, the coin and note controllers 410, 509 outputs drive signals to specified devices to pay out a change. In the coin and note depositing/dispensing apparatuses 400, 500, the coin and note controllers 410, 509 perform local depositing and dispensing (depositing of money used as changes and checking of the deposited money) independently from the central controller 209. The coin storing apparatus 600 is directly connected with the cash register 20 without being connected via a local controller, and a money storing box 602 is opened and closed by an input signal from the operation input portion 204.

The coin and note depositing depositing/dispensing apparatuses 400 and 500 are constructed by installing specified devices in a box-shaped casing which is long along forward and backward directions. Operation units 402 and 502 in which respectively operation keys 403 and 503 and a display 404 and 504 made of LED or the like are provided respectively at a front part of the upper surface of the casing 401 and 502. The coin depositing/dispensing apparatus 400 comprises a coin slot 405 used to deposit coins at the left side of the operation unit 402 and a coin outlet formed with a receptacle 407 is provided on the front surface of the casing 401. The note depositing/dispensing apparatus 500 comprises on its front surface of the casing 501 a note inlet 505 used to deposit notes and a note outlet 506.

After a specified operation is performed using the operation keys 403, the coins are introduced into the casing 401 by being thrown into the coin slot 405, the types of the coins are detected by an unillustrated coin sensor, and the detection result is inputted to the coin controller 410. The already deposited coins can be dispensed by a specified operation. Further, a change is discharged onto the receptacle 407 of the coin outlet 406 in accordance with a control signal outputted from the coin controller 410.

The coin depositing/dispensing apparatus 400, the note depositing/dispensing apparatus 500, and the money storing apparatus 600 are provided with lead wires 408, 507, 603 (electrical connecting portions) having connection terminals 409, 508, 604 provided at their leading ends for introducing power from a power supply and various electrical control signals and detection signals, etc. via the cash register 20. Further, the respective casings 401, 501, 601 are provided with unillustrated fitting terminals into which the connection terminals are fitted for the electrical connection between the coin depositing/dispensing apparatus 400, the note depositing/dispensing apparatus 500, and the money storing apparatus 600. On the other hand, the cash register 20 is provided with a power line 210 for supplying a power from an external commercial power supply, and an unillustrated fitting terminal into which any one of the connection terminals 409, 508, 604 is fitted.

Accordingly, by connecting any one of the connection terminals 409, 508, 604 with the cash register 20 with the power line 210 connected with the external power supply, any one of the coin depositing/dispensing apparatus 400, the note depositing/dispensing apparatus 500, and the money storing apparatus 600 is electrically connected with the cash register 20. Further, by connecting one of the remaining two apparatuses with the one connected with the cash register 20, power can be supplied to two of the three money handling apparatuses 300 via the cash register 20, and electrical signals can be transmitted and received between the selected three apparatuses.

The first type of money accounting machine 11 (see FIG. 13) is formed by connecting the coin depositing/dispensing apparatus 400 and the money sorting apparatus 600 with the cash register 20. The second type of money accounting machine 12 (see FIG. 14) is formed by connecting the note depositing/dispensing apparatus 500 and the money storing apparatus 600 with the cash register 20. The third type of money accounting machine 13 (see FIG. 15) is formed by connecting the coin depositing/dispensing apparatus 400 and the note depositing/dispensing apparatus 500 with the cash register 20.

Figure 13:
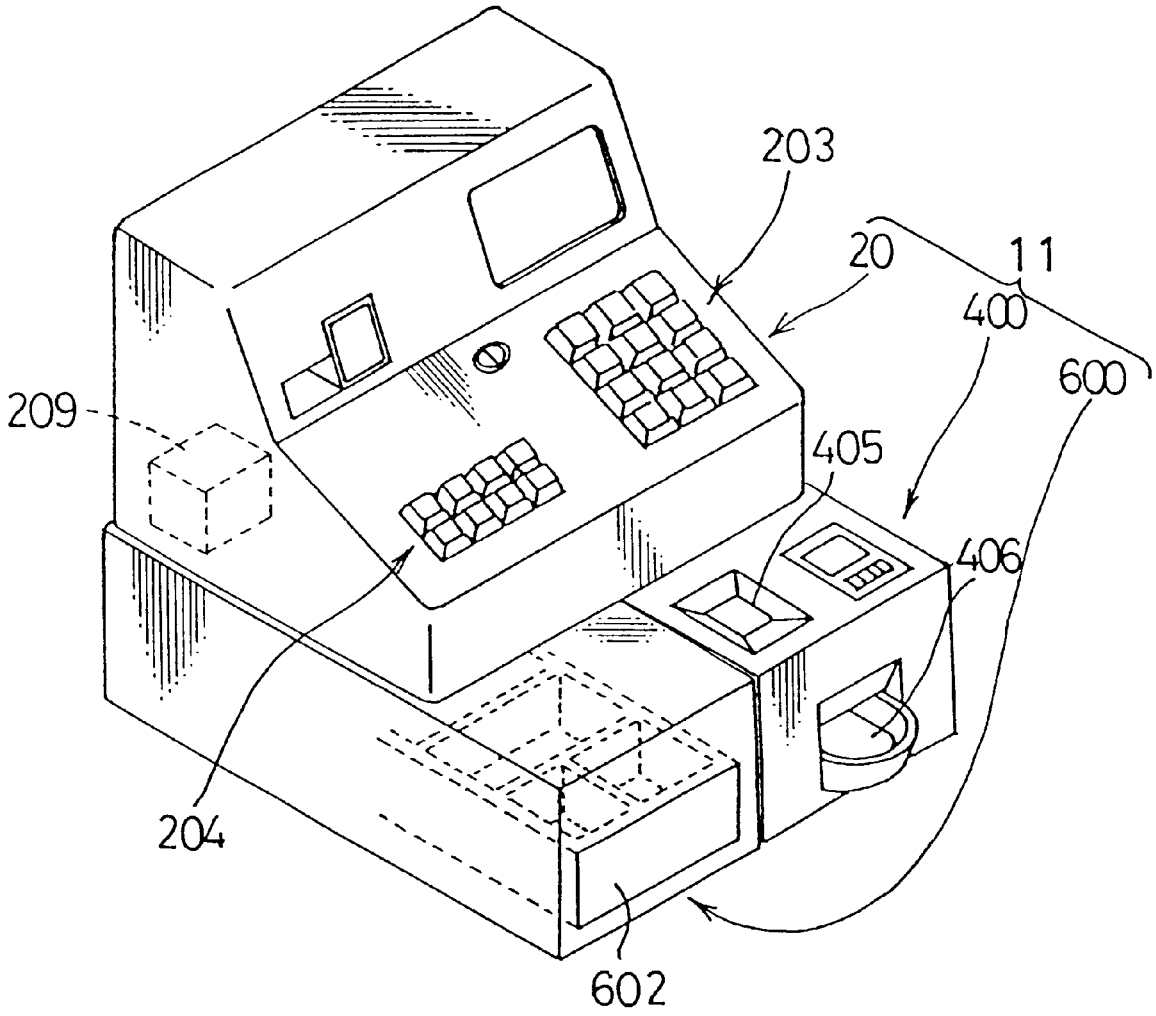
FIG. 13 is a perspective view showing a first type of money accounting machine.

FIG. 13 is a perspective view of the first type of money accounting machine 11. In this used state, the first type of money accounting machine 11 is constructed by placing the cash register 20 on the rear parts of the upper surfaces of the coin depositing/dispensing apparatus 400 and the money storing apparatus 600 without using the note depositing/dispensing apparatus 500. The central controller 209 of the cash register 20 and the coin controller 410 of the coin depositing/dispensing apparatus 400 is connected by a signal conductor, so that the change information can be outputted from the central controller 209 to the coin controller 410. Upon the receipt of the change information, the coin controller 410 outputs drive signals to various devices (for example, a motor of an unillustrated coin feeder, a coin throw-in sensor, a coin discriminating sensor of a coin selecting portion, a coin counting sensor of a coin storing hopper, a coin pay-out mechanism, etc.), and detection signals from various sensors are inputted thereto.

By the above arrangement, the detection signals from the coin throw-in sensor and the coin discriminating sensor of the coin depositing/dispensing apparatus 400 are inputted to the coin controller 410. On the other hand, input signals from the amount input portion 203 and the operation input portion 204 of the cash register 20 are sent as control signals to the coin depositing/dispensing apparatus 400 via the central controller 209 and the coin controller 410. The control signals are outputted in view of the above detection signals, so that proper commands (drive signals) are outputted to the respective devices in the coin depositing/dispensing apparatus 400 from the central controller 209. The coins can be properly deposited in and dispensed from the coin depositing/dispensing apparatus 400 by performing the specified operations in the respective devices.

In the first type of money accounting machine 11, notes are manually deposited and dispensed using the money storing apparatus 600. The cash register 20 and the money storing apparatus 600 are electrically connected only by a signal conductor for transmitting a control signal to unlock the coin storing box 602 locked by an unillustrated locking device. It should be noted that the cash register 20 and the money storing apparatus 600 may be directly electrically connected by a conventional method as in this embodiment or may be connected via the coin depositing/dispensing apparatus 400.

A specific exemplary operation of the first type of money accounting machine 11 is as follows. First, an amount of goods or commodities purchased by a customer is inputted to the central controller 209 by a key input operation or being read by an unillustrated bar code reader. Let it be assumed that a total amount is $96.54 and the customer gives a $100-note. In such a case, the received $100-note is first inputted using the amount input portion 203, and a change of $3.46 is calculated by the central controller 209. The received note is stored in the money storing box 602 drawn out by performing a specified input operation using the operation input portion 204.

On the other hand, the central controller 209 outputs information on a part of the change to be paid in coins, i.e., 46 cents to the coin controller 410. Upon receiving this information, the coin controller 410 outputs a control signal to a specified coin pay-out mechanism 48 g of the coin storing hopper 48 to drive the coin pay-out mechanism 48 g so that 46 cents (4×Dime, 1×Nickel, 1×Cent) are discharged onto the coin outlet 406 via a conveyor. A sum of the thus dispensed 46 cents and three $1-notes taken out of the money storing box 602, i.e., $3.46 is given to the customer as a change.

The first type of money accounting machine 11 is preferably used in such types of businesses where coins are often used as changes, such as retail stores handling groceries and supermarkets.

Figure 14:
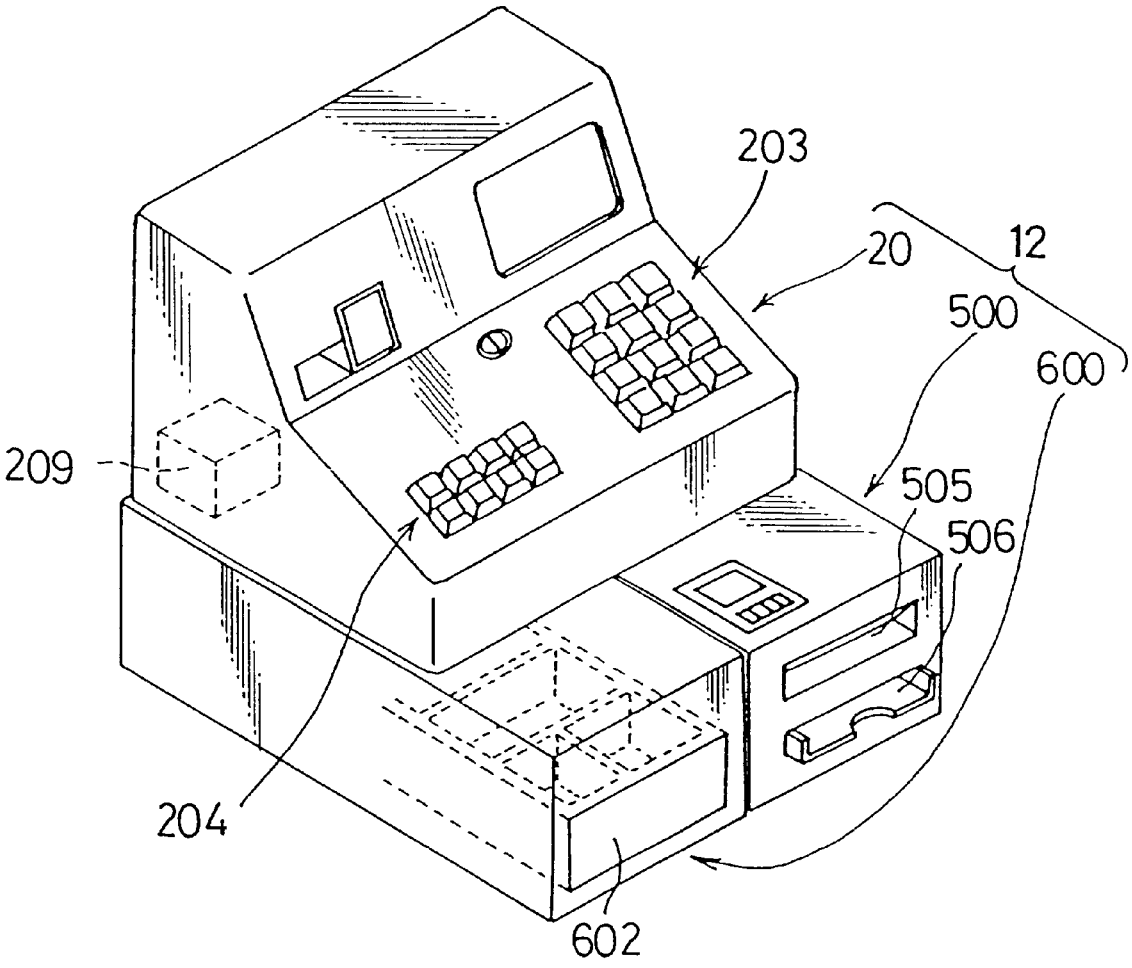
FIG. 14 is a perspective view showing a second type of money accounting machine.

FIG. 14 is a perspective view of the second type of money accounting machine 12. As shown in FIG. 14, the second type of money accounting machine 12 is constructed by placing the cash register 20 on the rear parts of the upper surfaces of the note depositing/dispensing apparatus 500 and the money storing apparatus 600 laid side by side. The central controller 209 of the cash register 20 and the note controller 509 of the note depositing/dispensing apparatus 500 are connected by a signal conductor. Drive signals are outputted from the note controller 509 to various devices (for example, an unillustrated note feeder, a note insertion sensor, a note discriminating sensor of a note discriminating portion, and a note feed sensor of a stacker, a feed belt, a feed roller, etc) in the note depositing/dispensing apparatus 500. Detection signals from the respective sensors are inputted to the note controller 501.

By the above arrangement, the change information from the cash register 20 is transmitted in the form of a control signal to the note depositing/dispensing apparatus 500. Upon receiving this control signal, the note controller 509 outputs proper commands (control signals) to the respective devices in the note depositing/dispensing apparatus 500 while referring to the detection signals from the respective sensors. The notes can be properly deposited in and dispensed from the note depositing/dispensing apparatus 500 by performing specified operations in the respective devices.

In the second embodiment, the coins are manually deposited and dispensed using the money storing apparatus 600. The cash register 20 and the money storing apparatus 600 are electrically connected only by a signal conductor for transmitting a control signal to unlock the coin storing box 602 locked by an unillustrated locking device. It should be noted that the cash register 20 and the money storing apparatus 600 may be directly electrically connected by a conventional method as in this embodiment or may be connected via the note depositing/dispensing apparatus 500.

A specific exemplary operation of the second type of money accounting machine 12 is as follows. First, an amount of goods or commodities purchased by a customer is inputted to the central controller 209 by a key input operation or being read by an unillustrated bar code reader. Let it be assumed that a total amount is $396.54 and the customer gives four $100-notes. In such a case, the received $400 is first inputted using the amount input portion 203, and a change of $3.46 is calculated by the central controller 209. The money storing box 602 is drawn out by performing a specified input operation using the operation input portion 204.

On the other hand, the note controller 509 outputs control signals to the feed belt, the feed roller and pay-out conveyor of the unillustrated stacker for dispensing. Accordingly, $3 (3×$1-note) are discharged onto a note outlet 506 via a note discharging mechanism by driving the feed belt and the like. A sum of the thus dispensed $3 and coins of 46 cents taken out of the money storing box 602, i.e., $3.46 is given to the customer as a change. The received four $100-notes are stored in a hopper of a specified note type via a note inlet 505.

The second type of money accounting machine 12 is preferably used in retail stores handling high-priced commodities for which notes are often given as a change.

Figure 15:
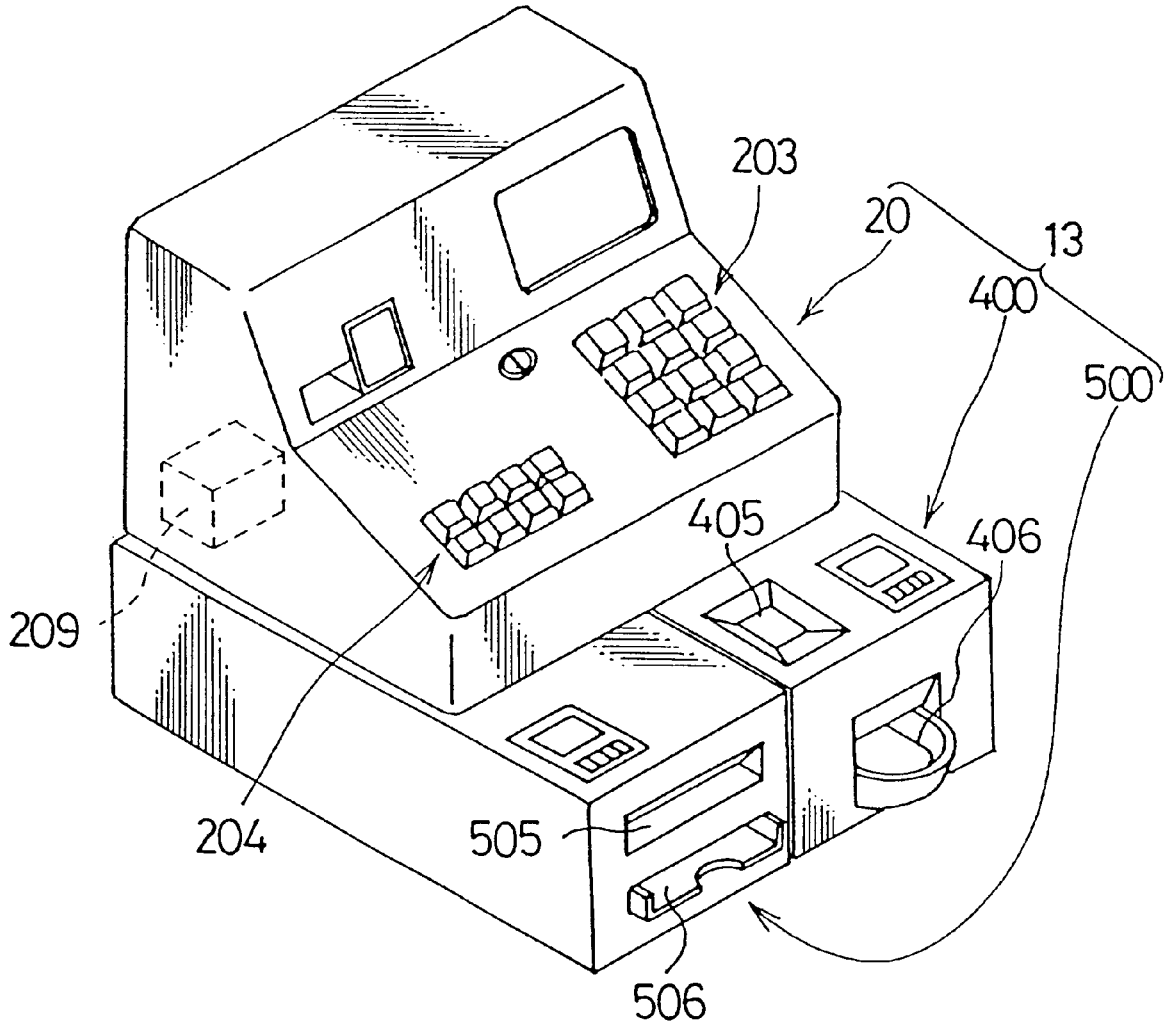
FIG. 15 is a perspective view showing a third type of money accounting machine.

FIG. 15 is a perspective view of the third type of money accounting machine 13. As shown in FIG. 15, the third type of money accounting machine 13 is constructed by placing the cash register 20 on the rear parts of the upper surfaces of the coin and note depositing/dispensing apparatuses 400 and 500 laid side by side. The central controller 209 of the cash register 20 and the respective devices in the coin and note depositing/dispensing apparatuses 400, 500 are connected by signal conductors for transmitting and receiving various data such as control signals and detection signals via the coin and note controllers 410, 509. The functions of the coin and note depositing/dispensing apparatuses 400, 500 are as described above. The coins and notes can be automatically deposited and dispensed by the coin and note depositing/dispensing apparatuses 400, 500.

Since the coins are deposited and dispensed by the coin depositing/dispensing apparatus 400 and the notes are deposited and dispensed by the note depositing/dispensing apparatus 500 in the third embodiment, it is not necessary to manually calculate a change using the money storing apparatus 600 as in the first and second embodiments. Accordingly, the third embodiment is very convenient in quickly and accurately depositing and dispensing the money. The third type of money accounting machine 13 can be applied to every kind of business and has a wide range of application.

The present invention is not limited to the above combinations of the coin depositing/dispensing apparatus 400, the note depositing/dispensing apparatus 500 and the money storing apparatus 600, i.e., two of the apparatuses 400, 500, 600 with the cash register 20. All three apparatuses 400, 500, 600 may be combined and connected with the cash register 20.

A money accounting machine 11 (12, 13) is constructed by combining any two of the coin depositing/dispensing apparatus 400, the note depositing/dispensing apparatus 500 and the money storing apparatus 600 with the cash register 20, thereby forming a money accounting machine 11 (12, 13) for performing accounting in the first line of the actual business.

The widths of the coin depositing/dispensing apparatus 400, the note depositing/dispensing apparatus 500 and the money storing apparatus 600, which are in the form of a rectangular parallelepiped, are set slightly larger than half the width of the cash register 20, and their dimension along forward and backward directions is about 1.5 times the corresponding dimension of the cash register 20. With such dimensioning, various money accounting machines can be constructed by stably placing the cash register 20 on the rear sides of the upper surfaces of any two of the coin depositing/dispensing apparatus 400, the note depositing/dispensing apparatus 500 and the money storing apparatus 600 laid side by side.

According to the used state of the money accounting machine, the money accounting machine is constructed by the two selected apparatuses (from the coin depositing/dispensing apparatus 400, the note depositing/dispensing apparatus 500 and the money storing apparatus 600) and the cash register 20. Thus, the obtained money accounting machine is not provided with unnecessary money handling apparatuses. In other words, this money accounting machine is free from superfluous apparatuses and is actually wished by users. The money accounting machine can be offered at an inexpensive price since unnecessary functions are not added.

Since the coin depositing/dispensing apparatus 400, the note depositing/dispensing apparatus 500 and the money storing apparatus 600 have substantially flat upper surfaces and have substantially equal heights. Accordingly, the upper surfaces of the two selected ones of the money accounting machine laid side by side are substantially flush with each other. Therefore, the upper surfaces of the two apparatuses laid side by side can be effectively used as a table or the like on which various things can be placed.

Further, since the cash register 20 is placed on the two apparatuses selected from the coin depositing/dispensing apparatus 400, the note depositing/dispensing apparatus 500 and the money storing apparatus 600 laid side by side, the money accounting machine takes up a smaller area as compared to a case where the cash register 20 is placed next the two money handling apparatuses. Thus, a spare plane or surface near the cash register 20 can be effectively used as a placing surface for articles or a table.

Furthermore, the input operation unit is provided in the cash register 20, and the depositing/dispensing portions and the electrical connecting portions detachably attachable to the cash register 20 are provided in the coin depositing/dispensing apparatus 400 and the note depositing/dispensing apparatus 500. Accordingly, the depositing/dispensing portion of the coin depositing/dispensing apparatus 400 or the note depositing/dispensing apparatus 500 electrically connected with the cash register 20 can be caused to operate by giving a specified input operation using the input operation portion of the cash register 20. As a result, the money can be deposited and dispensed without particularly operating the coin depositing/dispensing apparatus 400 and the note depositing/dispensing apparatus 500.

In addition, since one of the two apparatuses selected from the coin depositing/dispensing apparatus 400, the note depositing/dispensing apparatus 500 and the money storing apparatus 600 is electrically connected with the cash register 20 via the other, the two money depositing/dispensing apparatuses can be connected with the cash register 20 although the cash register 20 is provided with only one connection terminal. Thus, a cost for parts and an assembling cost of the cash register 20 can be reduced.

As described above, an inventive money handling apparatus comprises a casing, a movable table insertably and withdrawably mounted in the casing, a note handling mechanism or depositing/dispensing mechanism mounted on the movable table for depositing or depositing/dispensing notes. The depositing/dispensing mechanism includes a first mechanism which is provided at a front side of the movable table with respect to a drawing direction and through which the notes pass at the time of depositing and/or dispensing, and a second mechanism which is provided at a rear side of the movable table with respect to the drawing direction and in which the deposited notes are stored. There is further provided a restricting device for restricting the drawing movement of the movable table from the casing to a first drawing position where only the first mechanism is exposed to the outside, and a restriction controller for releasing the restriction by the restricting device so as to enable the movable table to be drawn up to a second drawing position where the second mechanism is exposed to the outside.

With this money handling apparatus, upon the occurrence of a note jam in the depositing/dispensing mechanism, the jammed note can be removed by drawing the movable table from the casing up to the first drawing position where the first mechanism in which no notes are stored is exposed to the outside if a position of jamming is located in the first mechanism. Since the second mechanism for storing the notes is not exposed to the outside by being restricted by the restriction means, it is preferable in view of security. The restriction of the restricting device is released only when the position of jamming is located in the second mechanism, and the second mechanism is exposed to the outside by drawing the movable table up to the second drawing position. The jammed note can be removed from the exposed second mechanism.

Preferably, the movable table comprises a discriminator for discriminating the note type and genuineness of the note deposited at an entrance of a conveyance path for conveying the note; a feeder for feeding the note to a storing end corresponding to the discrimination result; a dispenser for dispensing a note from its storing end by a specified input operation; and a depositing/dispensing processor for registering a depositing/dispensing data by detecting the depositing/dispensing of the note(s), and the second mechanism is so constructed as to store only the already registered deposited notes.

With this money handling apparatus, if a note jam occurs in the first mechanism, the jammed deposited note has not yet been counted for the balance calculated by the depositing/dispensing processor, i.e., has not yet been registered, the note removed from the position of jamming may be fed again to the entrance of the conveyance path after the movable table is accommodated in the casing. If a note jam occurs in the second mechanism, the jammed deposited note has already been registered by the depositing/dispensing processor. Accordingly, the movable table is entirely drawn from the casing to expose the second mechanism to the outside, and the note removed from the position of jamming may be returned to the note storing end of the second mechanism.

Thus, the note deposited right now and thus not yet counted for the balance calculated by the depositing/dispensing processor is held in the first mechanism while the note already registered thereby is held in the second mechanism. Accordingly, a register operator can handle a slight note jam occurred immediately after the depositing by removing the jammed note after drawing the movable table from the casing such that only the first mechanism is exposed and by feeding the removed note again to the first mechanism after the movable table is pushed back into the casing. Therefore, the inconvenience to let customers wait for a long time can be solved. Further, the slight note jam can be handled without exposing the second mechanism containing many notes to the outside, which brings about a big advantage in view of security.

The movable table may be drawn up to the second drawing position to expose the second mechanism only when a note jam occurs after the note has been registered.

Preferably, there are further provided a first locking device for enabling the movable table to be drawn from the casing by unlocking the movable table; and a second locking device as a restriction releasing device for restricting a drawing position of the movable table to the first drawing position while being effected and permitting the movable table to be drawn up to the second drawing position while being unlocked.

With this money handling apparatus, the movable table is drawn to the first drawing position by unlocking the first locking device, thereby exposing only the first mechanism, if a note jam occurs in the first mechanism. It is convenient in view of security since the second mechanism storing many notes is not exposed to the outside. Accordingly, a register operator can remove the jammed note in front of customers without calling an administrator. Therefore, this apparatus is effective in quickly solving the jamming problem.

If a note jam occurs in the second mechanism, the second locking device is unlocked to permit the movable table to be drawn up to the second drawing position, enabling the jammed note to be removed from the second mechanism.

Preferably, the restriction releasing device unlocks the second locking device by a key operation. With this arrangement, if a note jam occurs in the second mechanism, the second locking device is unlocked by the key operation to permit the movable table to be drawn up to the second drawing position, enabling the jammed note to be removed from the second mechanism. Since the key operation is required to draw the movable table to the second drawing position, the second mechanism storing many notes can be drawn out only a person holding a key. This is preferable in view of security.

Preferably, the first and second mechanism include jam detector for detecting a note jam, respectively, and the money handling apparatus further comprises a first display device for displaying the detection result of the jam detector.

With this money handling apparatus, upon the occurrence of a note jam, whether the note jam has occurred in the first or second mechanism can be easily confirmed by seeing a display on the first display device. Then, an operator can clearly understand what he should do to remove the jammed note. Therefore, this apparatus is effective in properly dealing with a trouble.

Preferably, each detector is so arranged as to detect whether or not the note jam has occurred after being registered, and the money handling apparatus further comprises a second display unit for displaying the detection result as to whether or not the note jam has occurred after being registered.

With this money handling apparatus, whether the jammed note has already been registered or not can be confirmed when a note jam occurs. This makes it clear how the note removed from the position of jamming should be handled.

As this invention may be embodied in several forms without departing from the spirit of essential characteristics thereof, the present embodiment is therefore illustrative an not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A money handling apparatus, comprising:

a casing;

a movable table insertably and withdrawably mounted in the casing;

a note handling mechanism mounted on the movable table for performing deposition of notes, the note handling mechanism including:

a first mechanism provided at a front side of the movable table with respect to a drawing direction for transferring a note rearward at the time of depositing; and a second mechanism provided at a rear side of the movable table with respect to the drawing direction for permitting the deposited note to be stored;

a restricting device for restricting the drawing movement of the movable table from the casing to a first drawing position where only the first mechanism is exposed to the outside; and a restriction controller for releasing the restriction of the restricting device so as to enable the movable table to be drawn up to a second drawing position where the second mechanism is exposed to the outside.

2. A money handling apparatus according to claim 1, wherein the note handling mechanism is operable to perform dispensing of notes in addition to deposition of notes, and the first mechanism permits notes to pass at the time of dispensing as well as depositing.

3. A money handling apparatus according to claim 2, wherein:

the movable table includes:

a discriminator for discriminating the note type and genuineness of a note deposited at an entrance of a conveyance path for conveying notes;

a feeder for feeding a note to a storing position corresponding to the discrimination result;

a dispenser for dispensing a note from a storing position by a specified input operation; and a processor for registering deposition and dispensing data by detecting deposition and dispensing of notes; and the second mechanism permits only registered deposited notes to be stored.

4. A money handling apparatus according to claim 3, further comprising:

a first locking device for enabling the movable table to be drawn from the casing by unlocking the movable table; and a second locking device as a restriction releasing device for restricting a drawing position of the movable table to the first drawing position while being effected and permitting the movable table to be drawn up to the second drawing position while being unlocked.

5. A money handling apparatus according to claim 4, wherein the restriction releasing device unlocks the second locking device by a key operation.

6. A money handling apparatus according to claim 5, wherein the first and second mechanisms each include a jam detector for detecting a note jam, and the apparatus further comprising a first display device for displaying detection result of the jam detector.

7. A money handling apparatus according to claim 6, wherein each detector detects whether or not a note jam has occurred after being registered, and the apparatus further comprising a second display unit for displaying detection result as to whether or not a note jam has occurred after being registered.

8. A money handling apparatus according to claim 3, wherein the first and second mechanisms each include a jam detector for detecting a note jam, and the apparatus further comprising a first display device for displaying detection result of the jam detector.

9. A money handling apparatus according to claim 8, wherein each detector detects whether or not a note jam has occurred after being registered, and the apparatus further comprising a second display unit for displaying detection result as to whether or not a note jam has occurred after being registered.

10. A money handling apparatus according to claim 2, further comprising:

a first locking device for enabling the movable table to be drawn from the casing by unlocking the movable table; and a second locking device as a restriction releasing device for restricting a drawing position of the movable table to the first drawing position while being effected and permitting the movable table to be drawn up to the second drawing position while being unlocked.

11. A money handling apparatus according to claim 10, wherein the restriction releasing device unlocks the second locking device by a key operation.

12. A money handling apparatus according to claim 2, wherein the first and second mechanisms each include a jam detector for detecting a note jam, and the apparatus further comprising a first display device for displaying detection result of the jam detector.

13. A money handling apparatus according to claim 12, wherein each detector detects whether or not a note jam has occurred after being registered, and the apparatus further comprising a second display unit for displaying detection result as to whether or not a note jam has occurred after being registered.

* * * * *

UNITED STATES PATENT AND TRADEMARK OFFICE

CERTIFICATE OF CORRECTION

PATENT NO. : 6,435,329 B1
DATED : August 20, 2002
INVENTOR(S) : Isao Amari et al.

It is certified that error appears in the above-identified patent and that said Letters Patent is hereby corrected as shown below:

Title page,
Item [73], replace "Nihon Kinsel Kikai Kabushiki Kaisha" to
-- Nihon Kinsen Kikai Kabushiki Kaisha --

Signed and Sealed this

Twenty-fifth Day of March, 2003

JAMES E. ROGAN
*Director of the United States Patent and Trademark Office*